US006556169B1

(12) United States Patent
Fukuura et al.

(10) Patent No.: US 6,556,169 B1
(45) Date of Patent: Apr. 29, 2003

(54) HIGH FREQUENCY CIRCUIT INTEGRATED-TYPE ANTENNA COMPONENT

(75) Inventors: Atsuomi Fukuura, Kagoshima (JP); Akinori Sato, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 19 days.

(21) Appl. No.: 09/691,453

(22) Filed: Oct. 18, 2000

(30) Foreign Application Priority Data

Oct. 22, 1999 (JP) ..... 11-301708
Mar. 15, 2000 (JP) ..... 2000-072747
Apr. 28, 2000 (JP) ..... 2000-130988

(51) Int. Cl.[7] ..... H01Q 1/38
(52) U.S. Cl. ..... 343/700 MS; 343/853
(58) Field of Search ..... 343/700 MS, 853, 343/767, 702; H01Q 1/38

(56) References Cited

U.S. PATENT DOCUMENTS 4,761,654 A * 8/1988 Zaghloul ..... 343/700 MS

* cited by examiner

*Primary Examiner*—Michael C. Wimer
(74) *Attorney, Agent, or Firm*—Hogan & Hartson, LLP

(57) ABSTRACT

A high frequency circuit integrated-type antenna component including a dielectric board having a high frequency circuit formed on its surface or in its inner part, a grounding layer formed on a surface, where the high frequency circuit is not formed, of the dielectric board, an antenna element provided in or on the grounding layer, and a coupling circuit for signal transmission between the antenna element and the high frequency circuit. The high frequency circuit includes a demultiplexing circuit or a multiplexer, for example. The antenna element may be formed on an antenna board fixed to a grounding layer, and may be a slot antenna formed in the grounding layer.

23 Claims, 21 Drawing Sheets

HIGH FREQUENCY CIRCUIT INTEGRATED-TYPE ANTENNA COMPONENT

BACKGROUND OF THE INVENTION

1. Field of the Invention

The present invention relates generally to a high frequency circuit integrated-type antenna component used as an antenna for communication.

Examples of the antenna component include an antenna integrated-type demultiplexer board in which an antenna element and a demultiplexer board are integrated with each other.

2. Description of Related Art

The current trend in the design of radio communication devices is to provide devices capable of coping with a plurality of different communication systems. In such a communication device, components for radio communication capable of transmitting and receiving a plurality of signals in different frequency bands which correspond to the different communication systems are required. In order to keep the entire communication device small and lightweight, it is required that each of the components is made multi-functional and is made small and lightweight.

An antenna is one of the largest components used for the radio communication device. One method of reducing the size of the antenna is to form a resonance-type antenna including an antenna element whose length is smaller than a wavelength and an impedance converter. An example of the antenna is a microstrip antenna. However, the antenna thus miniaturized are liable to have narrow band characteristics. Therefore, when the antenna is utilized for the radio communication device capable of coping with the plurality of systems, a plurality of antennas must be used. Even when an antenna in another form is used, the wider a frequency range to which the communication device should correspond is, the more difficult a single small-sized antenna which can be utilized is to find out.

In the radio communication device comprising individual antennas for a plurality of communication systems, a plurality of power feeding lines for respectively transmitting signals between the antennas and transmitters-receivers corresponding thereto are required. In order to make the communication device small and lightweight and reduce the cost thereof, it is desirable that the number of components is reduced by sharing the components. In feeding power to the antennas, it is desirable to use one power feeding line, if possible.

A circuit as shown in FIG. 20 or FIG. 21, for example, is used, in order to distribute a signal from a single transmission line, through which a plurality of signals having different frequencies are transmitted, into different transmission lines for the frequencies or to synthesize the plurality of signals having different frequencies, which have been received by the plurality of antennas, into a single transmission line.

In the circuit shown in FIG. 20, a signal from a single transmission line 81 through which a plurality of signals having different frequencies are transmitted is distributed into a plurality of transmission lines 82*a,* 82*b,* and 82*c.* Thereafter, the signals having the respective signal frequencies are selectively passed by filters 83*a,* 83*b,* 83*c* respectively adaptable to the signal frequencies, and are respectively transmitted to antenna elements 85*a,* 85*b,* and 85*c* via power feeding lines 84*a,* 84*b,* and 84*c.*

In the circuit shown in FIG. 21, a single transmission line 86 through which a plurality of signals having different frequencies are transmitted is connected to a demultiplexer 87. A signal from the transmission line 86 is branched for the different frequencies by the demultiplexer 87, and signals obtained by the branching are respectively transmitted to antenna elements 89*a,* 89*b,* and 89*c* via power feeding lines 88*a,* 88*b,* and 88*c.*

In the circuit shown in FIG. 20, however, signal power is wasted because it is divided.

On the other hand, the circuit shown in FIG. 21 is advantageous in that signal power is not wasted. In an actual structure of the circuit shown in FIG. 21, however, the antenna elements 89*a,* 89*b,* and 89*c* and the demultiplexer 87 are separately formed and then electrically line-connected to each other. In a case where the power is fed to a plurality of antennas via a demultiplexer from one power feeding line, however, if the power feeding line between the demultiplexer and the antenna is long, the loss of the signal power is increased.

On the other hand, it is also proposed that the demultiplexer and the antenna are formed on a surface of a dielectric board. Because the demultiplexer and the antenna are provided within the same plane, the power feeding line can be shortened. However, the dielectric board is required to have an area corresponding to both the antenna and the demultiplexer, which is unfavorable for miniaturization. If the demultiplexer is brought too close to the antenna, the antenna and the demultiplexer interfere with each other, which may degrade characteristics.

SUMMARY OF THE INVENTION

An object of the present invention is to provide a high frequency circuit integrated-type antenna component which can be miniaturized by integrally forming an antenna and a high frequency circuit (a stacked circuit section) such as a demultiplexer.

Another object of the present invention is to provide an antenna integrated-type demultiplexer board capable of preventing an antenna and a demultiplexer from interfering with each other.

Still another object of the present invention is to provide a chip antenna component having a high degree of freedom in design.

The inventors have found out that the above-mentioned objects are achieved by integrally forming an antenna element and a demultiplexer board provided with a demultiplexing circuit as well as forming a grounding layer between the antenna element and the demultiplexing circuit as a result of making various considerations in order to solve the above-mentioned problems in the prior art.

The inventors have found out that the same object is achieved by arranging, where an antenna element is a slot antenna, a slot on a grounding layer formed on a surface or in an inner part, where the demultiplexing circuit is not provided, of the demultiplexer board such that signal transmission to the demultiplexing circuit is allowed.

Specifically, the antenna integrated-type demultiplexer board according to the present invention is constructed by forming a demultiplexing circuit (an example of a high frequency circuit) on a surface or in an inner part of a dielectric board, forming a grounding layer on a surface, where the demultiplexing circuit is not provided, of the dielectric board, forming an antenna element in the grounding layer or disposing the antenna element on the grounding layer, and connecting the antenna element and the demultiplexing circuit such that signal transmission is allowed.

In the above-mentioned construction, it is desirable that the demultiplexing circuit comprises a directional filtering circuit comprising a directional coupling circuit and a ring-type resonance circuit. Further, it is desirable that the demultiplexing circuit comprises a plurality of directional filtering circuits which differ in operation frequencies in order to correspond to a plurality of different frequencies to be used, and the plurality of directional filtering circuits are arranged in descending order of the operation frequencies from the side of power feeding.

A slot antenna is suitable for the antenna element in the grounding layer. It is desirable that signal transmission is made by electromagnetically coupling the antenna element to the demultiplexing circuit. Further, a plane-type antenna such as a microstrip antenna, or a dielectric resonator antenna is suitable as the antenna element disposed on the grounding layer. It is desirable that the signal transmission is made to the demultiplexing circuit by providing a through conductor penetrating through the dielectric board from the demultiplexing circuit and extending into the dielectric resonator antenna and connecting the through conductor to the demultiplexing circuit.

An antenna board provided with the antenna element on a dielectric board may integrally mounted on the demultiplexer board.

In this case, a grounding layer may be provided on one of surfaces, a surface of the antenna board, or an antenna mounting surface of the demultiplexer board. Alternatively, the antenna board and the demultiplexer board may respectively comprise grounding layers, and the grounding layers may be electrically connected to each other.

In the antenna board, a plurality of antenna elements which differ in operation frequencies can be also provided on one of surfaces of the dielectric board. Further, a plurality of antenna boards respectively provided with the antenna elements which differ in the operation frequencies may be integrally mounted on a surface of the demultiplexer board.

A chip antenna component according to the present invention is constructed by integrally forming an antenna element and a stacked circuit section comprising at least one signal input terminal and two or more signal output terminals and connecting at least one of the signal output terminals to the antenna element.

According to the construction, it is possible to provide a small-sized chip antenna component which has a small mounting area, has a high degree of freedom in antenna arrangement, and is easily subject to change in design in feeding a signal having a plurality of frequencies to a plurality of antennas using one power feeding line or in forming an array antenna.

In the above-mentioned construction, it is desirable that a demultiplexing circuit and/or a multiplexer is formed in the stacked circuit section. It is desirable that the demultiplexing circuit and the multiplexer respectively comprise directional filtering circuits each comprising a directional coupling circuit and a ring-type resonance circuit. It is desirable that the antenna element is a plane-type antenna such as a microstrip antenna.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
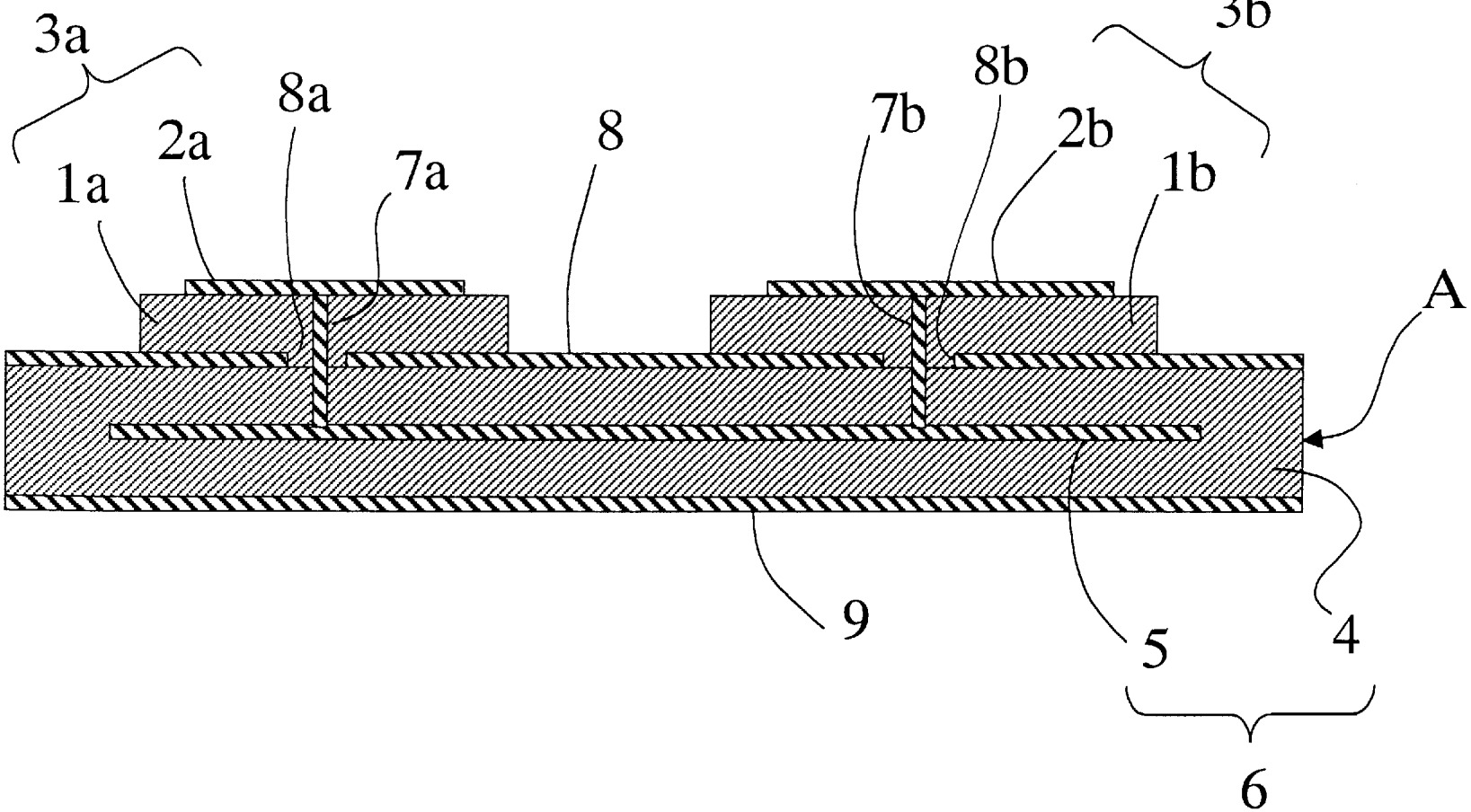
FIG. 1 is a schematic sectional view of an antenna integrated-type demultiplexer board according to a first embodiment of the present invention.
Figure 2:
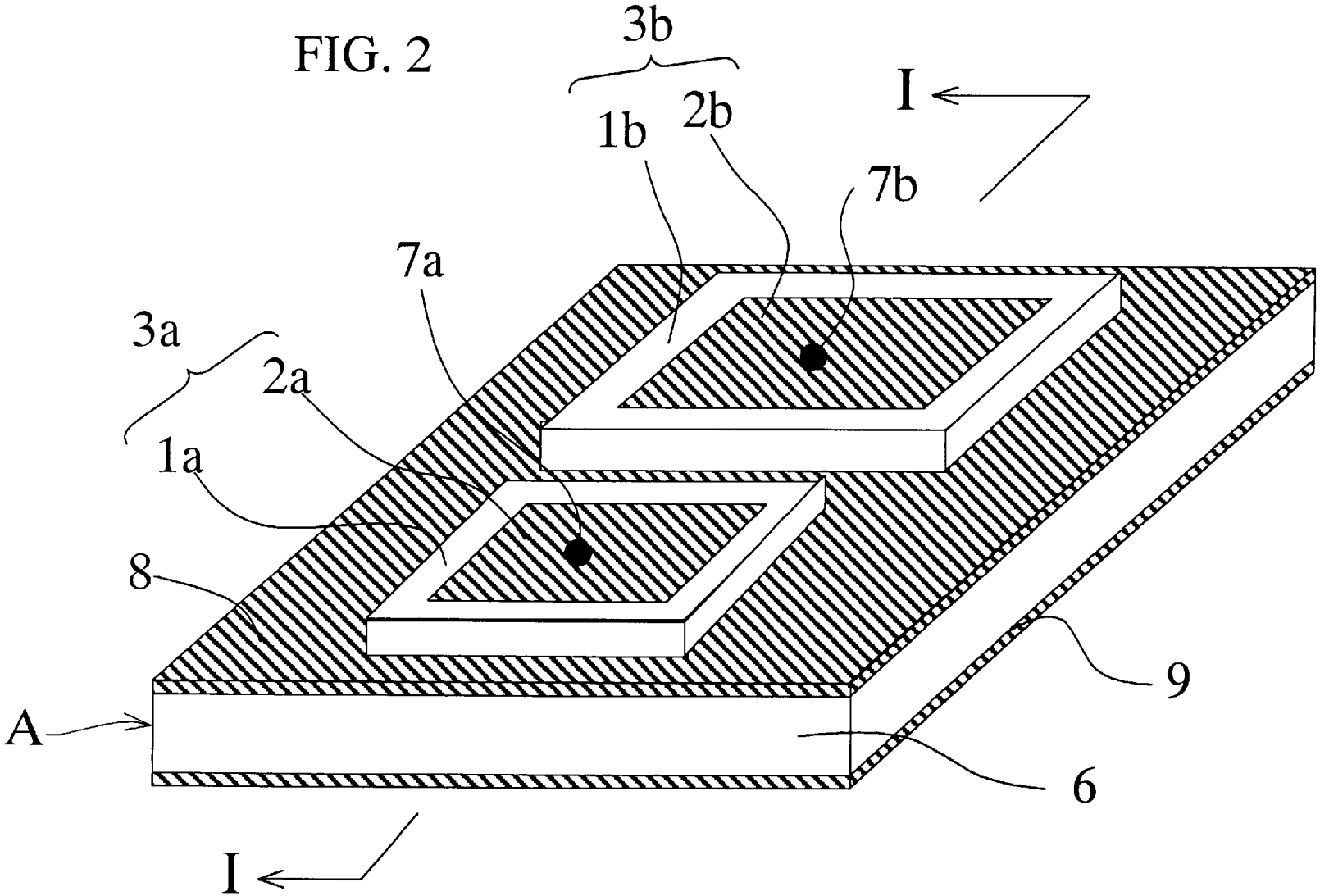
FIG. 2 is a schematic perspective view of the antenna integrated-type demultiplexer board shown in FIG. 1.

FIG. 1 is a schematic sectional view (a cross section taken along a line I—I in FIG. 2) of an antenna integrated-type demultiplexer board A according to a first embodiment of the present invention, and FIG. 2 is a schematic perspective view thereof. The antenna integrated-type demultiplexer board A comprises two antenna boards 3*a* and 3*b*, and a blanching filter board 6. The antenna boards 3*a* and 3*b* have antenna elements 2*a* and 2*b* provided on respective one surfaces of dielectric boards 1*a* and 1*b*. The demultiplexer board 6 contains a demultiplexing circuit 5 formed inside a dielectric board 4. The antenna boards 3*a* and 3*b* and the demultiplexer board 6 are joined to and integrated with each other by integrally mounting the antenna boards 3*a* and 3*b* on a surface, where the demultiplexing circuit 5 is not provided, of the demultiplexer board 6. The antenna elements 2*a* and 2*b* and the demultiplexing circuit 5 are electrically connected to each other by through conductors 7*a* and 7*b* provided in the dielectric boards 1*a* and 1*b* and the dielectric board 4.

A grounding layer 8 is applied to a joint surface of the demultiplexer board 6 to the antenna boards 3*a* and 3*b*. The grounding layer 8 has opening 8*a* and 8*b* through which the through conductors 7*a* and 7*b* respectively penetrate the grounding layer 8, whereby the grounding layer 8 is kept in a non-contact state with the through conductors 7*a* and 7*b*. The grounding layer 8 may be formed on a joint surface of the antenna boards 3*a* and 3*b* to the demultiplexer board 6 instead of being formed on the joint surface of the demultiplexer board 6 to the antenna boards 3*a* and 3*b*. Further, grounding layers may be respectively formed on the joint surfaces of both the boards 3*a,* 3*b* and 6, and joined to each other.

In the antenna boards 3*a* and 3*b,* the antenna elements 2*a* and 2*b* and the grounding layer 8 form a microstrip antenna. Further, a grounding layer 9 is applied to the other surface of the dielectric board 4. The grounding layers 8 and 9 and the demultiplexing circuit 5 form a circuit of a strip line.

Figure 21:
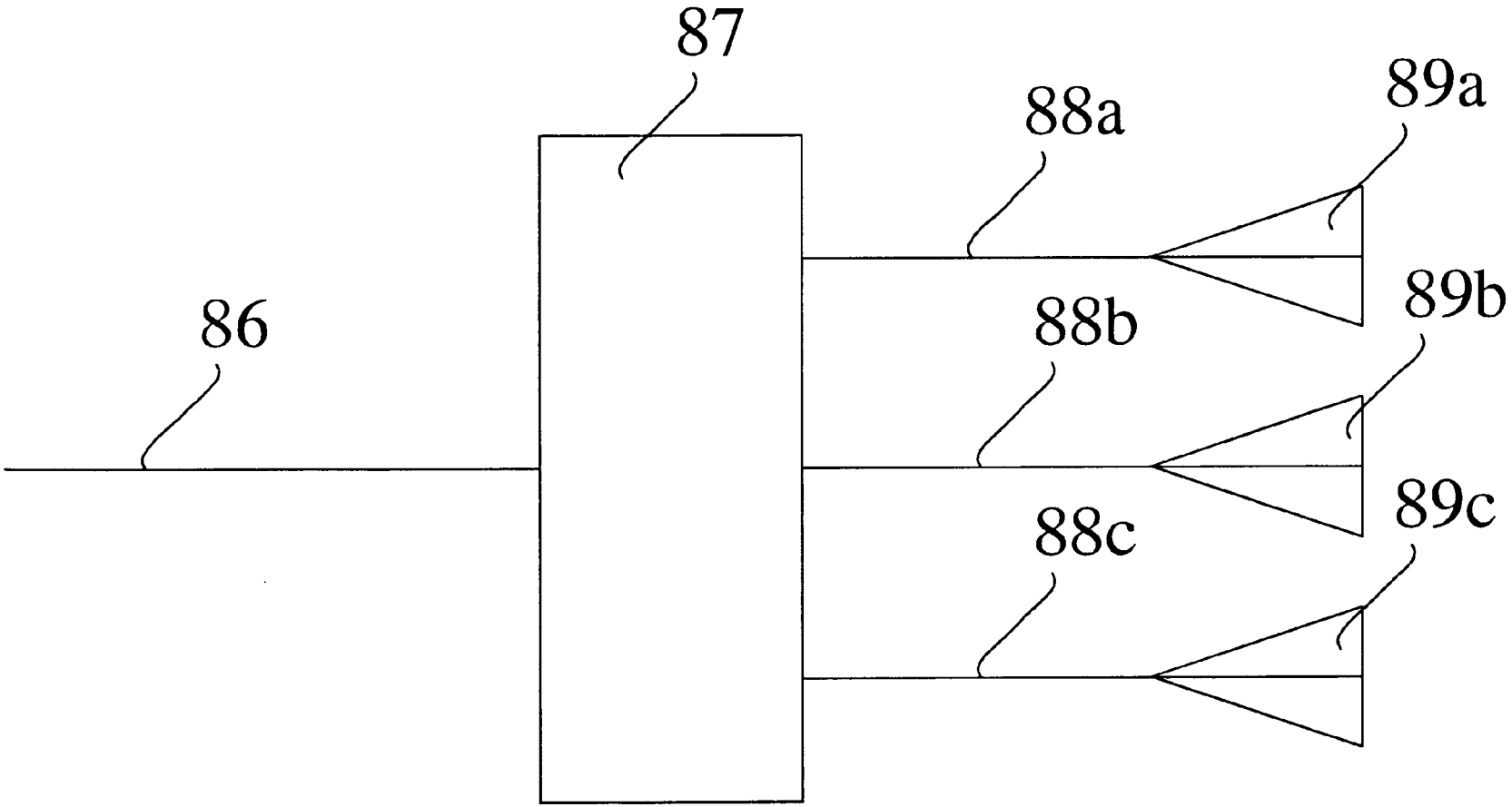
FIG. 21 is a conceptual view of another circuit comprising an antenna and a demultiplexing circuit.

According to the present invention, the antenna boards 3*a* and 3*b* and the demultiplexer board 6 are joined to and integrated with each other by the above-mentioned construction, so that the antenna integrated-type demultiplexer board is small and lightweight. Moreover, when a circuit for feeding power to a plurality of antennas from one power feeding line via a demultiplexer is formed, as shown in FIG. 21, the length of the power feeding line between the demultiplexer and the antenna, that is, the through conductors 7*a* and 7*b* can be decreased, thereby making it possible to reduce the loss of signal power. Further, the grounding layer 8 is interposed between the antenna elements 2*a* and 2*b* and the demultiplexing circuit 5, thereby preventing the characteristics of the antenna integrated-type demultiplexer board from being degraded by interference of electromagnetic fields respectaively radiated from the antenna elements 2*a,* 2*b* and the demultiplexing circuit 5.

Figure 3:
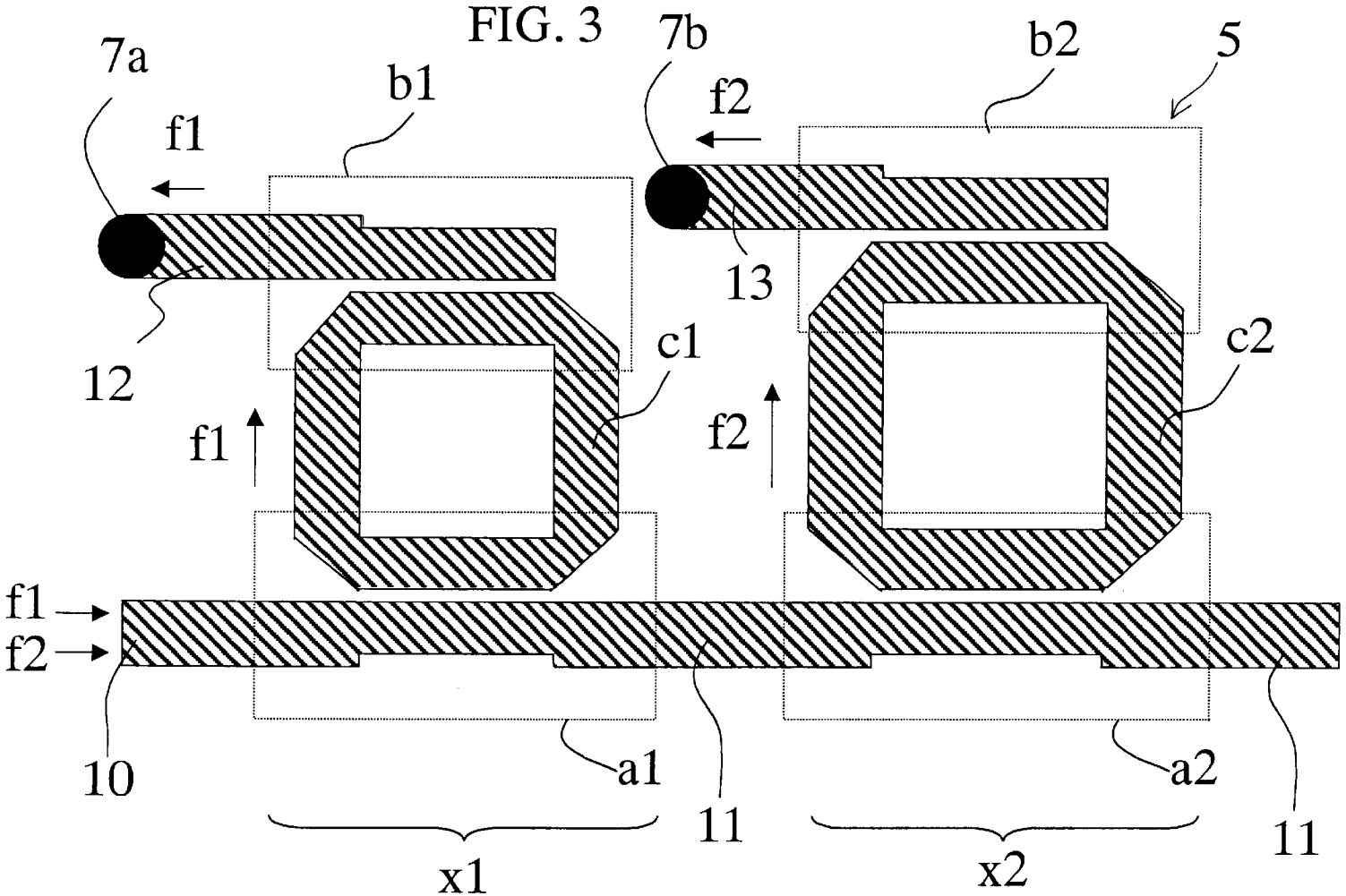
FIG. 3 is a pattern view for explaining a demultiplexing circuit in the antenna integrated-type demultiplexer board shown in FIG. 1.

Although a known circuit can be used as the demultiplexing circuit 5, an example of its specific circuit pattern is illustrated in FIG. 3. The demultiplexing circuit 5 comprises a directional filtering circuit x (x1, x2) comprising directional coupling circuits a (a1, a2) and b (b1, b2) and a ring-type resonance circuit c (c1, c2) Although the number of directional filtering circuits is adjusted by the number of signals to be obtained by branching, two directional filtering circuits x1 and x2 are provided in FIG. 3.

In the demultiplexing circuit 5 shown in FIG. 3, two signals f1 and f2 having different frequencies are inputted from the a port 10 on the side of a transmitter-receiver. One signal f1 of the two signals f1 and f2 is coupled to the ring-type resonance circuit c1 from a transmission line 11 by the directional coupling circuit a1 at a frequency determined by the directional coupling circuit a1 and the ring-type resonance circuit c1 in the first directional filtering circuit x1. The signal f1 is further coupled to another transmission line 12 from the ring-type resonance circuit c1 by the directional coupling circuit b1 formed on the opposite side of the directional coupling circuit a1 about the ring-type resonance circuit c1. The signal f1 is then transmitted to the antenna element 2*a* via the through conductor 7*a* serving as a power feeding line.

The other signal f2 is coupled to the ring-type resonance circuit c2 by the directional coupling circuit a2 after traveling through the transmission line 11, at a frequency determined by the directional coupling circuit a2 and the ring-type resonance circuit c2 in the directional filtering circuit x2 next to the directional filtering circuit x1. The signal f2 is further coupled to another transmission line 13 from the ring-type resonance circuit c2 by the other directional coupling circuit b2. The signal f2 is then transmitted to the antenna element 2*b* via the through conductor 7*b* serving as a power feeding line.

A frequency component of a signal which has not been branched by the two directional filtering circuits x1 and x2 further travels through the transmission line 11. When the frequency component is an unnecessary component such as a higher-harmonic component generated by a mixer circuit or an amplifier, for example, an attenuator or the like is provided at a terminal end of the transmission line 11, to attenuate the frequency component. A third signal can be included in the frequency component of the signal which has not been branched by the two directional filtering circuits x1 and x2. In the case, the terminal end of the transmission line 11 may be connected to a third antenna element (not shown).

When the signal inputted from the port 10 includes three or more signals having different frequencies, directional filtering circuits, whose number corresponds to the number of the signals, may be provided along the transmission line 11 to branch the signals, as in FIG. 3.

In the demultiplexing circuit 5, it is desirable that the plurality of directional filtering circuits x1 and x2 are arranged in descending order of their operation frequencies from the side of the port 10. That is, f1>f2 in FIG. 3. The reason for this is that when the directional filtering circuits are arranged in ascending order of the operation frequencies (that is, f1<f2), a signal component having the higher frequency f2 may leak out to the directional filtering circuit x1 by higher-order resonance in the first directional filtering circuit x1 operating at the lower frequency f1. In this case, the signal f2 may be prevented from being correctly extracted in the second directional filtering circuit x2 arranged next to the first directional filtering circuit x1.

In the demultiplexing circuit 5 shown in FIG. 3, signals are coupled to the ring-type resonance circuits c1 and c2 and then coupled to the other transmission lines 12 and 13. These signals travel in a direction toward the through conductors 7*a* and 7*b* serving as power feeding lines, not to be transmitted in a direction away from the through conductors 7*a* and 7*b* in the transmission lines 12 and 13.

In the antenna integrated-type demultiplexer board A shown in FIGS. 1 and 2, the demultiplexing circuit 5 is provided inside the dielectric board 4. According to the present invention, however, the demultiplexing circuit 5 can be also formed on a surface, on the opposite side of a joint surface of the dielectric board 4 to the antenna board 3 (3*a,* 3*b*), of the dielectric board 4.

Figure 4:
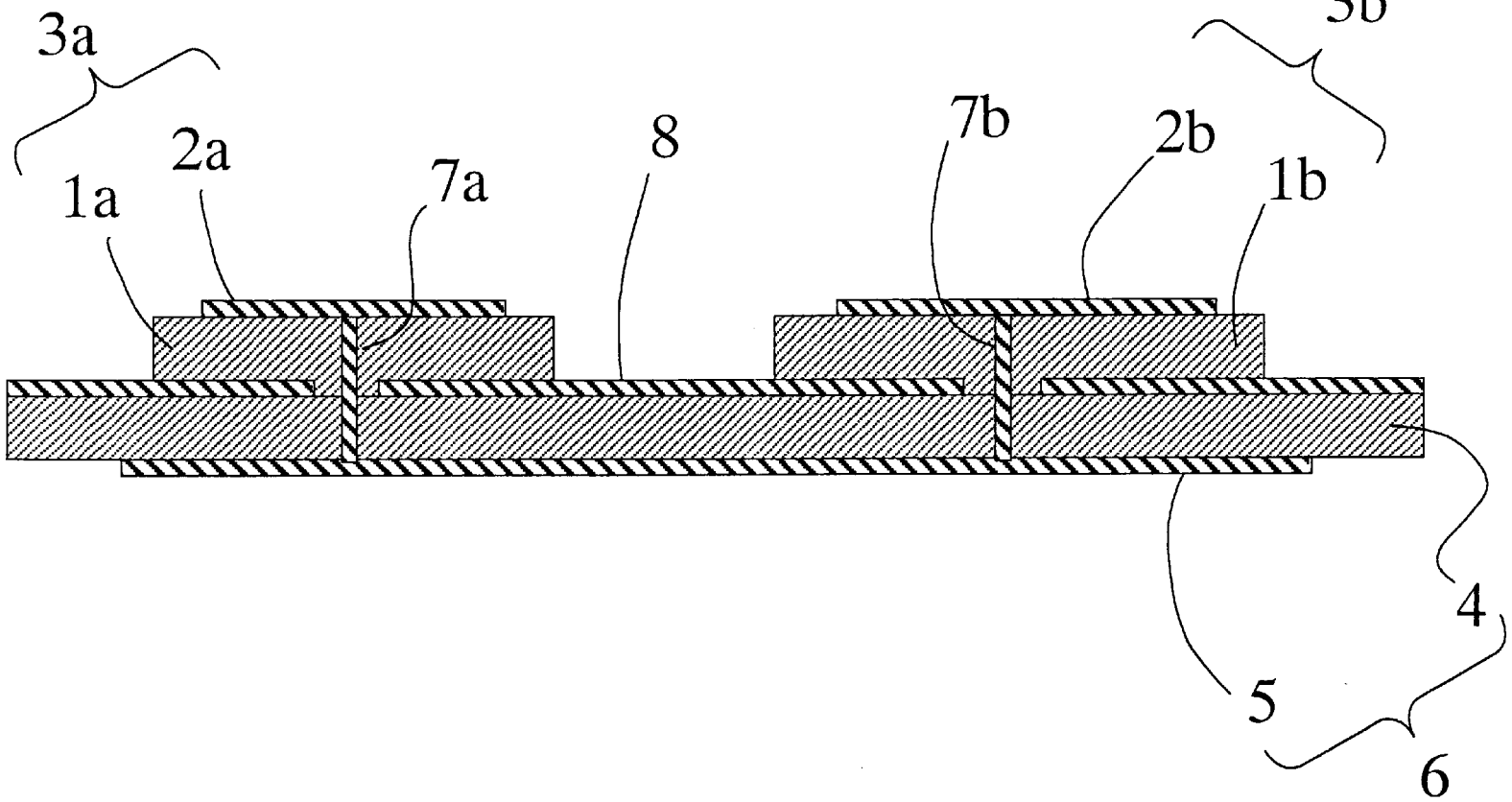
FIG. 4 is a schematic sectional view for explaining a modified example of the antenna integrated-type demultiplexer board.

Specifically, the demultiplexing circuit 5 may be applied to the surface on the opposite side of the joint surface of the dielectric board 4 to the antenna board 3 (3*a,* 3*b*), as shown in FIG. 4. The antenna elements 2 (2*a,* 2*b*) and the demultiplexing circuit 5 are electrically connected to each other by the through conductors 7 (7*a,* 7*b*) penetrating through the dielectric board 1 and the dielectric board 4. Further, the grounding layer 8 is applied to the joint surface of the demultiplexer board 6 to the antenna board 3 (3*a,* 3*b*).

Accordingly, it is possible to prevent the antenna elements 2 (2*a,* 2*b*) and the demultiplexing circuit 5 from interfering with each other.

Figure 5:
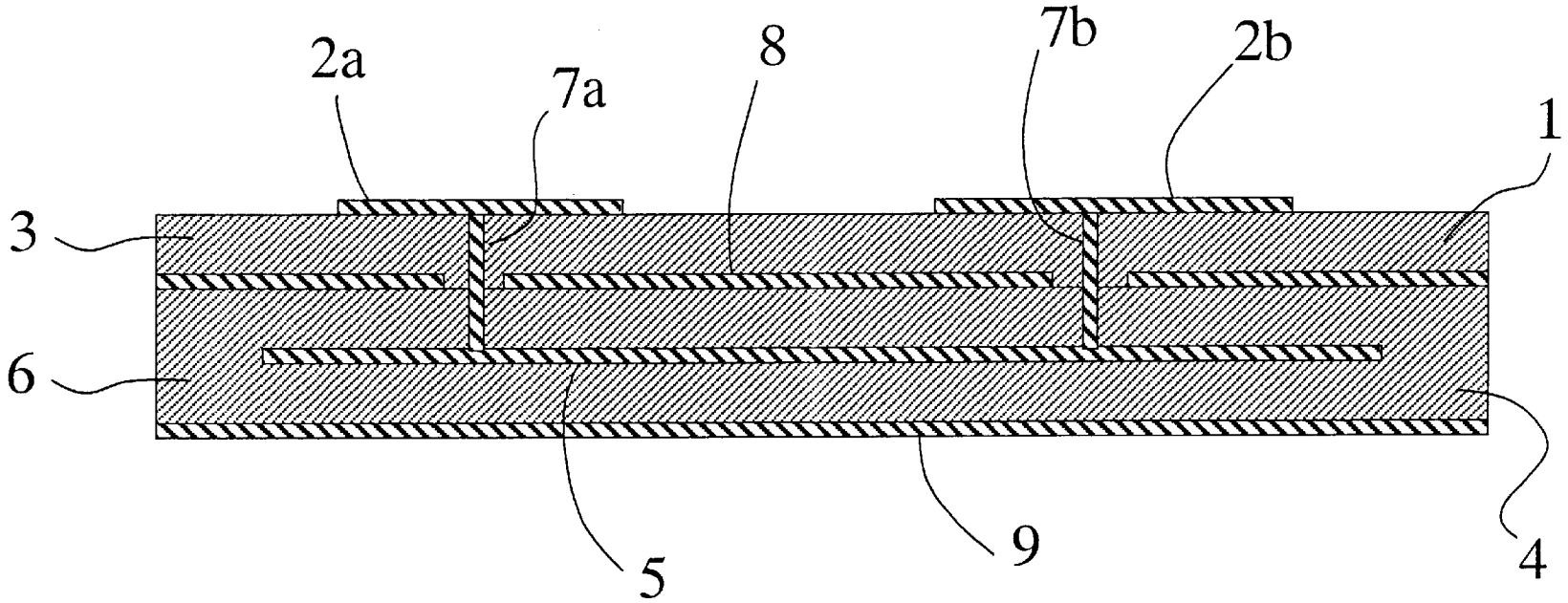
FIG. 5 is a schematic sectional view for explaining another modified example of the antenna integrated type demultiplexer board.
Figure 6:
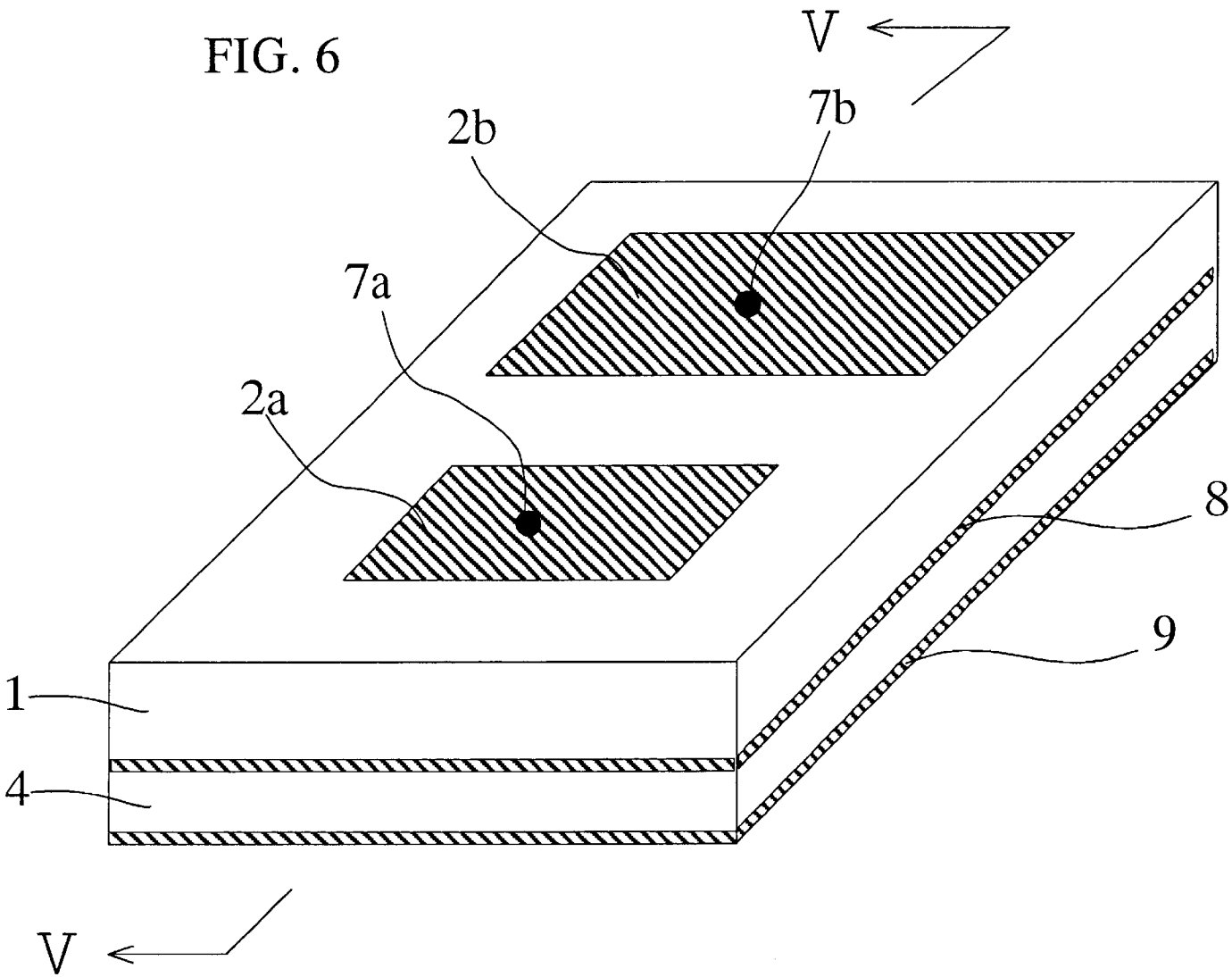
FIG. 6 is a schematic perspective view of the antenna integrated-type demultiplexer board shown in FIG. 5.

Although in the construction shown in FIGS. 1 to 4, the plurality of antenna boards 3 (3*a,* 3*b*) are integrally formed on the surface of the demultiplexer board 6, the plurality of antenna elements 2 (2*a,* 2*b*). may be formed on a surface of one dielectric board 1, as shown in a schematic sectional view of FIG. 5 and a schematic perspective view of FIG. 6.

The antenna board 3 can be joined to and integrated with the grounding layer 8 in the demultiplexer board 6 with adhesives or the like. When the dielectric boards 1 and 4 are composed of ceramics, the antenna board 3 and the demultiplexer board 6 can be integrated with each other by sintering.

The through conductor 7 is formed by filling a hole provided in the dielectric boards 1 and 4 with a conductor. The through conductor 7 can be also formed by embedding a metal pin in the dielectric boards 1 and 4. When the dielectric board is composed of ceramics, the antenna element 2 (2*a,* 2*b*), the grounding layers 8 and 9, the demultiplexing circuit 5, and the through conductors 7 (7*a,* 7*b*) can be integrated with the dielectric board by simultaneous sintering. That is, a metal paste pattern is applied to a surface of the dielectric board which has not been sintered yet, to form the antenna elements 2 (2*a,* 2*b*) the grounding layers 8 and 9, and the demultiplexing circuit 5. A through hole is formed in the dielectric board, and the through hole is filled with conductive paste, to form the through conductors 7 (7*a,* 7*b*). In this state, the dielectric board is sintered.

A method of feeding power from the demultiplexing circuit 5 to the antenna element 2 is not limited to a method of forming the through conductor 7. For example, the grounding layer 8 can be provided with a slot, to electromagnetically couple the antenna element 2 to the transmission lines 12 and 13 in the demultiplexing circuit 5.

In the antenna integrated-type demultiplexer board according to the present invention, at least one of two or more signals obtained by the branching by the demultiplexer board 6 may be connected to the antenna element in the antenna board 3 integrated with the demultiplexer board 6. The other signal obtained by the branching can be connected to a known external antenna element such as a wire antenna.

The dielectric boards 1 and 4 can be formed of a well-known insulating material, for example, a ceramic material such as alumina, glass, glass ceramics, or aluminum nitride; an organic insulating material containing organic resin such as epoxy resin; or an organic-ceramic composite material. The antenna element 2, the grounding layers 8 and 9, the demultiplexing circuit 5, and so forth are formed of a well-known conductive material such as copper, silver, gold, tungsten, or molybdenum.

Although the dielectric board 1 in the antenna board 3 and the dielectric board 4 in the demultiplexer board 6 may be formed of the same. dielectric material, a dielectric material having a suitable dielectric constant may be selected in consideration of a frequency to be used, a request for miniaturization, processing precision, and radiation efficiency.

Figure 7:
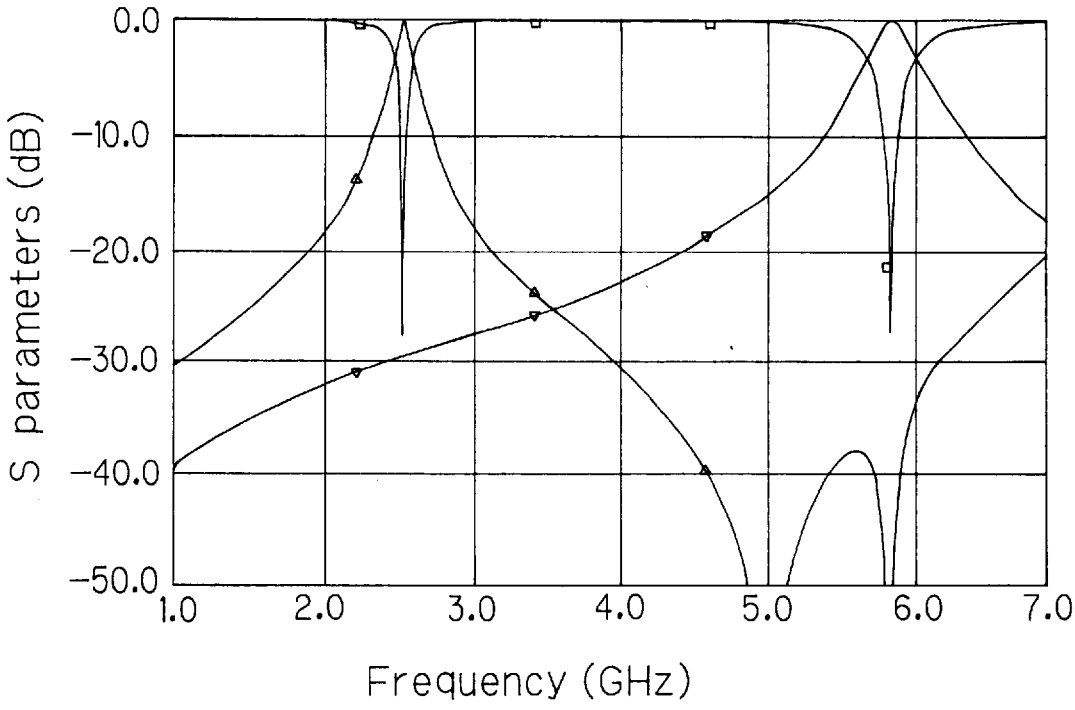
FIG. 7 shows the results of evaluating and analyzing branching by the demultiplexing circuit shown in FIG. 3.

The results of evaluating and analyzing the branching characteristics of the demultiplexing circuit 5 described in FIG. 3 are shown in FIG. 7. In the evaluation, a circuit shown in FIG. 3 composed of copper is formed in the dielectric board 4 having a dielectric constant of 4.9. As apparent from FIG. 7, a signal having a frequency of 2.5 GHz and a signal having a frequency of 5.8 GHz are obtained by the branching.

Figure 8:
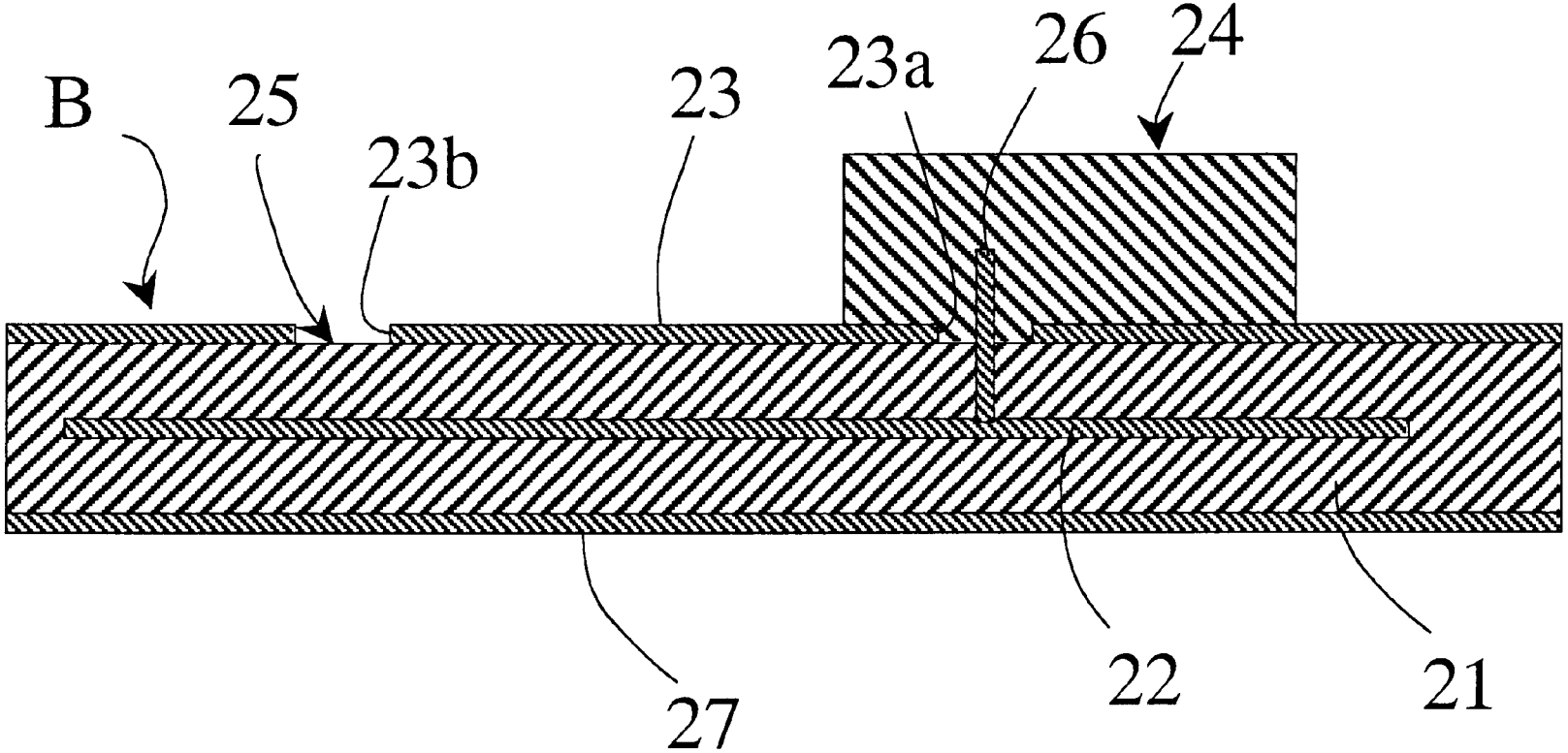
FIG. 8 is a schematic sectional view of an antenna integrated-type demultiplexer board according to a second embodiment of the present invention.
Figure 9:
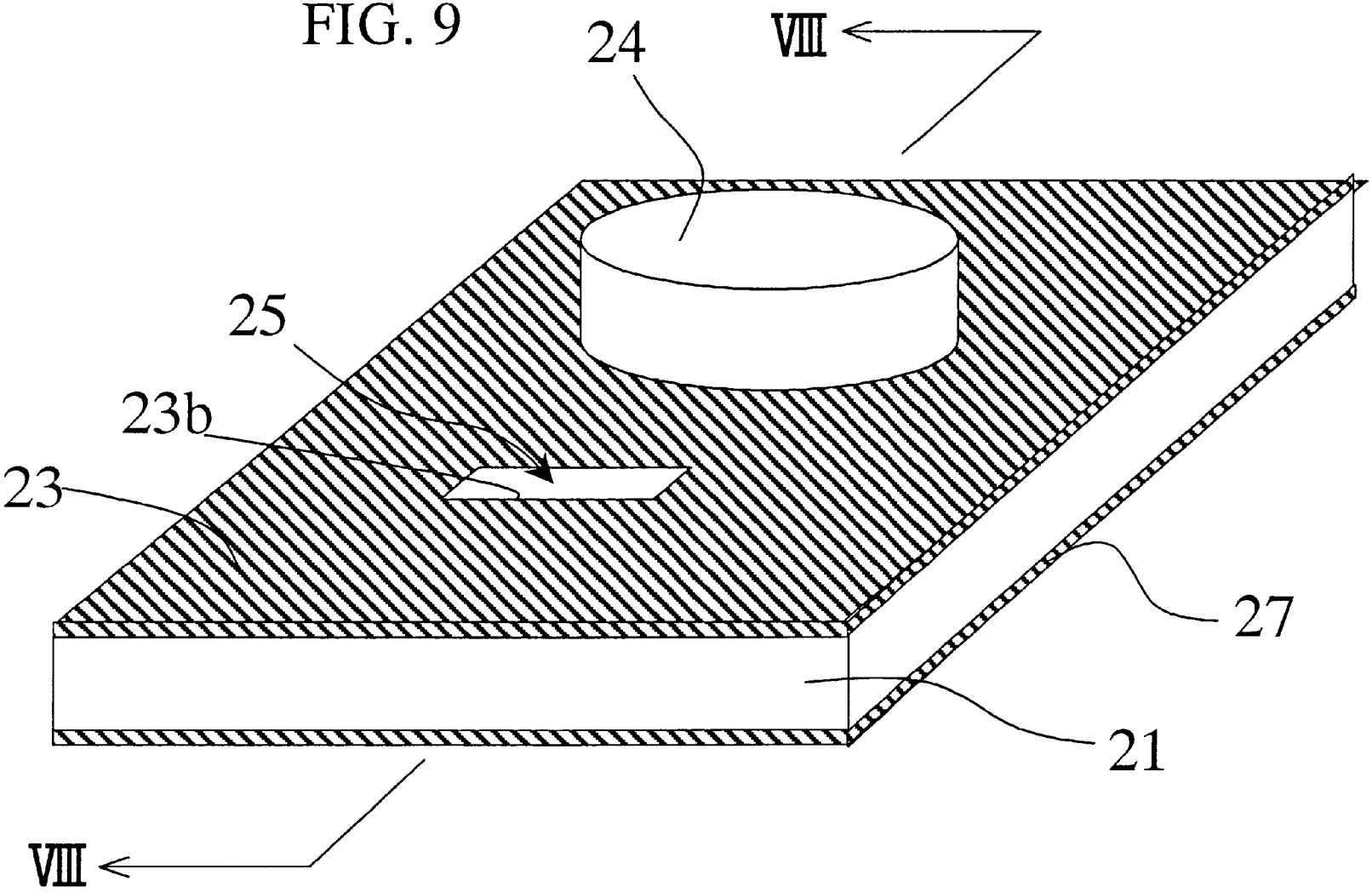
FIG. 9 is a schematic perspective view of the antenna integrated-type demultiplexer board shown in FIG. 8.

FIG. 8 is a schematic sectional view (a cross-section taken along a line VIII—VIII in FIG. 9) of an antenna integrated-type demultiplexer board B according to a second embodiment of the present invention, and FIG. 9 is a schematic perspective view thereof. According to the antenna integrated-type demultiplexer board B, a demultiplexing circuit 22 is contained inside a dielectric board 21, and a grounding layer 23 is applied to one surface of the dielectric board 21. A dielectric resonator antenna 24 is disposed integrally with the dielectric board 21 on the grounding layer 23, and a slot antenna 25 is formed inside the grounding layer 23.

An opening 23*a* is formed in the grounding layer 23 interposed between the dielectric resonator antenna 24 and the dielectric board 21. There is provided a through conductor 26 penetrating through the dielectric board 21 and passing through the opening 23*a* from the demultiplexing circuit 22 and extending into the dielectric resonator antenna 24.

The through conductor 26 extending into the dielectric resonator antenna 24 functions as a monopole antenna, and can transmit a signal between the demultiplexing circuit 22 and the dielectric resonator antenna 24.

The dielectric resonator antenna 24 resonates in an HEM11δ mode, for example, and functions as an antenna at a frequency in the vicinity of its resonance frequency.

On the other hand, the slot antenna 25 is formed as a slot hole 23*b* of predetermined size in the grounding layer 23. The slot hole 23*b* is formed at a position opposite to an end of a line of the demultiplexing circuit 22 formed inside the dielectric board 21. Consequently, the slot antenna 25 and the demultiplexing circuit 22 are electromagnetically coupled to each other, thereby making it possible to make signal transmission between the demultiplexing circuit 22 and the slot antenna 25.

Figure 10:
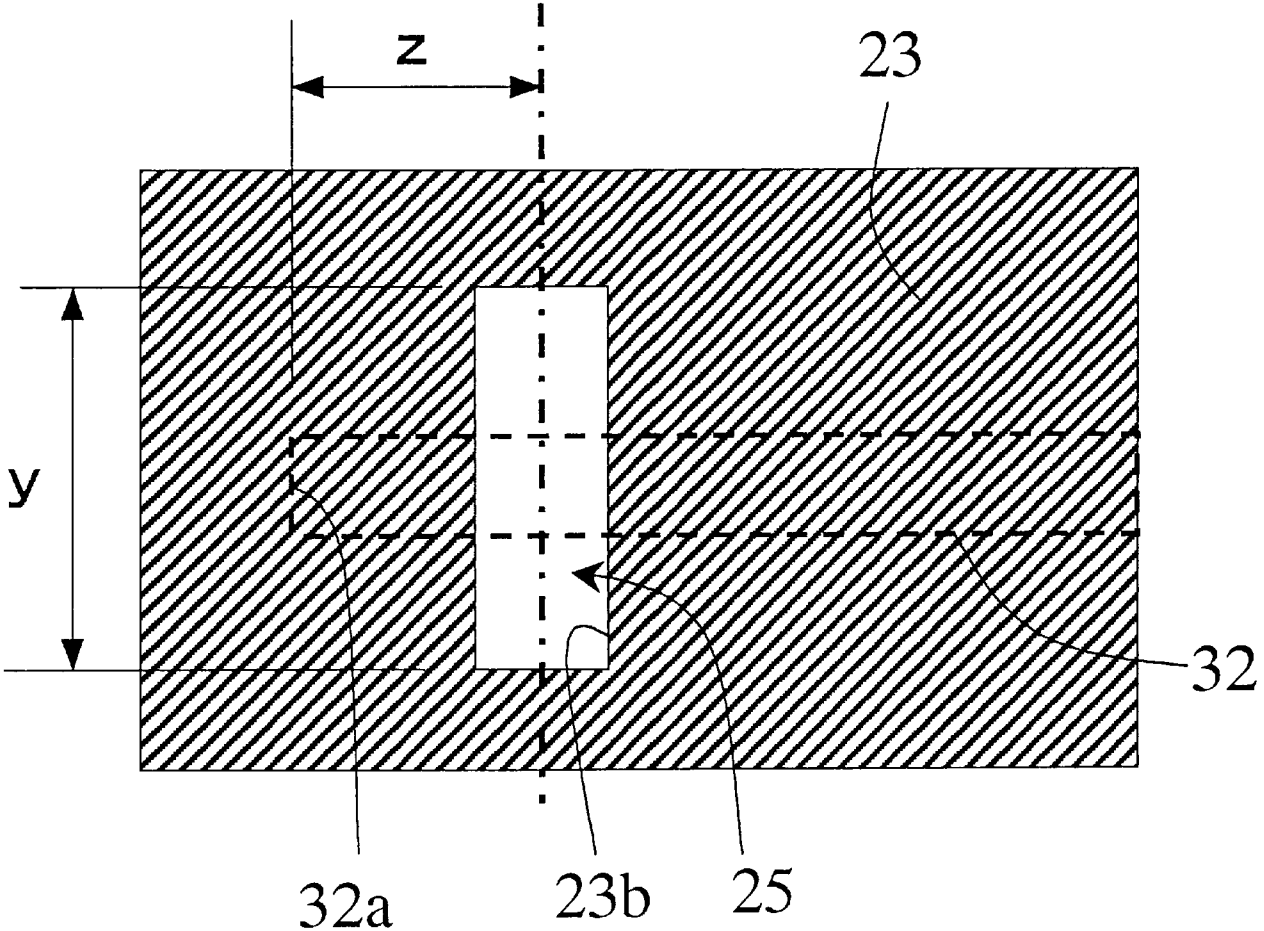
FIG. 10 is a plan view for explaining a coupling structure of a slot antenna and a demultiplexing circuit in the antenna integrated-type demultiplexer board shown in FIG. 8.

Specifically, the slot hole 23*b* in the grounding layer 23 and a terminal end 32*a* of a transmission line 32 in the demultiplexing circuit 22 are arranged so as to intersect each other, as viewed from the top, as shown in FIG. 10. That is, letting y be the length of the slot hole 23*b,* z be the length, projecting from the center of the slot hole 23*b,* of the transmission line 32, M1 be the wavelength of a signal in the transmission line 32, and M2 be the wavelength M2 of a signal in the slot hole 23*b,* a relationship of 2y=M2 and 4z=M1 is typically satisfied. In this case, the signal transmitted through the transmission line 32 is efficiently radiated from the slot hole 23*b* in the slot antenna 25, or the signal is efficiently received and transmitted to the transmission line 32 through the slot hole 23*b*.

In the antenna integrated-type demultiplexer board B shown in FIG. 8, the grounding layer 27 is also applied to the other surface of the dielectric board 21. The grounding layers 23 and 27 and the demultiplexing circuit 22 form a circuit of a strip line.

The dielectric resonator antenna element 24 and the dielectric board 21 having the demultiplexing circuit 22 are joined to and integrated with each other by the above-mentioned construction. Accordingly, the antenna integrated-type demultiplexer board can be made small and lightweight. Moreover, when a circuit for feeding power to a plurality of antennas from one power feeding line via a demultiplexer, as shown in FIG. 21, is formed, the length of the through conductor 26 serving as a power feeding line between the demultiplexing circuit 22 and the antenna element 24 can be made as small as possible, thereby making it possible to reduce the loss of signal power.

Furthermore, the grounding layer 23 is interposed between the dielectric resonator antenna element 24 and the demultiplexing circuit 22, thereby preventing the characteristics of the antenna integrated-type demultiplexer board from being degraded by interference of an electromagnetic field radiated from the antenna element 24 and an electromagnetic field generated by the demultiplexing circuit 22.

Figure 11:
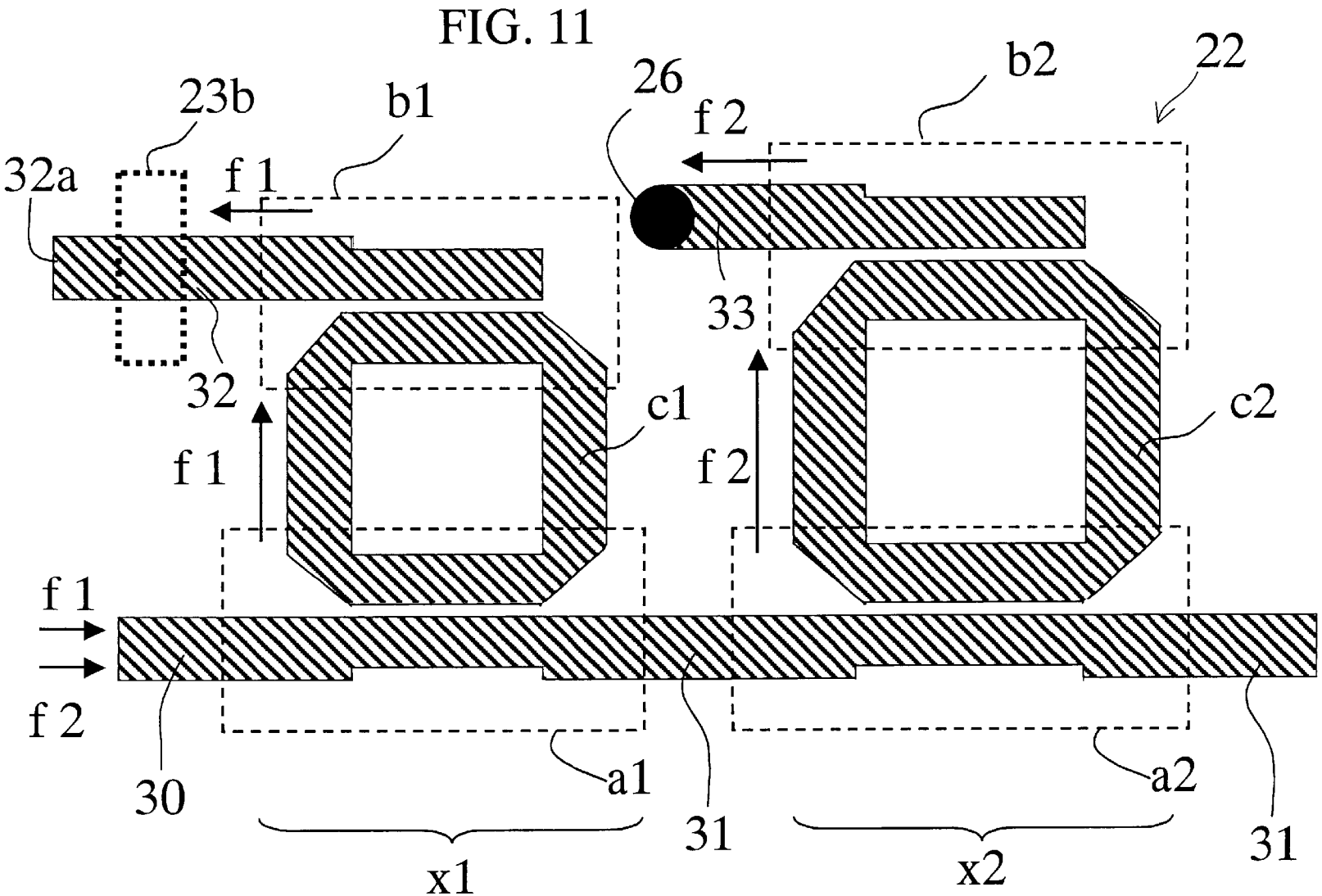
FIG. 11 is a pattern view for explaining a demultiplexing circuit in the antenna integrated-type demultiplexer board shown in FIG. 8.

Although a known circuit can be used as the demultiplexing circuit 22, an example of its specific circuit pattern is illustrated in FIG. 11. The demultiplexing circuit 22 comprises a directional filtering circuit x (x1, x2) comprising directional coupling circuits a (a1, a2) and b (b1, b2) and a ring-type resonance circuit c (c1, c2) Although the number of directional filtering circuits is adjusted by the number of signals to be obtained by branching, two directional filtering circuits x1 and x2 are provided in FIG. 11.

In the demultiplexing circuit 22 shown in FIG. 11, two signals f1 and f2 having different frequencies are inputted from a port 30 on the side of a transmitter-receiver. One signal f1 out of the two signals f1 and f2 is coupled to the ring-type resonance circuit c1 from a transmission line 31 by the directional coupling circuit a1 at a frequency determined by the directional coupling circuit a1 and the ring-type resonance circuit c1 in the first directional filtering circuit x1. The signal f1 is further coupled to another transmission line 32 from the ring-type resonance circuit c1 by the directional coupling circuit b1 formed on the opposite side of the directional coupling circuit a1 about the ring-type resonance circuit c1. The signal f1 is transmitted to the slot antenna 25 by opposing the slot antenna 25 and a terminal end of the transmission line 32 to each other.

The other signal f2 is coupled to the ring-type resonance circuit c2 by the directional coupling circuit a2, at a frequency determined by the directional coupling circuit a2 and the ring-type resonance circuit c2 in the directional filtering circuit x2 next to the directional filtering circuit x1 after traveling through the transmission line 31. The signal f2 is further coupled to another transmission line 33 from the ring-type resonance circuit c2 by the other directional coupling circuit b2. The signal f2 is then transmitted to the dielectric resonator antenna 24 via the through conductor 26 serving as a power feeding line for feeding power to the antenna element, the dielectric resonator antenna 24 in this embodiment.

A frequency component of a signal which has not been branched by the two directional filtering circuits x1 and x2 travels through the transmission line 31. When the frequency component is an unnecessary component such as a higher harmonic component generated by a mixer circuit or an amplifier, for example, an attenuator or the like is provided at a terminal end of the transmission line 31, to attenuate the frequency component. A third signal can be included in the frequency component of the signal which has not been branched by the two directional filtering circuits x1 and x2. In this case, a terminal end of the transmission line 31 may be connected to a third antenna element (not shown).

If the signal inputted from the power feeding port 30 includes three or more signals having different frequencies, directional filtering circuits whose number corresponds to the number of the signals may be provided along the transmission line 31 to branch the signal, as in FIG. 11.

In the demultiplexing circuit 22, it is desirable that the plurality of directional filtering circuits x1 and x2 are arranged in descending order of their operation frequencies from the side of the power feeding port 30 (that is, f2>f1). The reason for this is that when the directional filtering circuits are arranged in ascending order of the operation frequencies (that is, f1>f2), a signal component having the higher frequency may leak out to the directional filtering circuit x1 by higher-order resonance in the first directional filtering circuit x1 operating at the lower frequency. In this case, the signal component having the higher frequency may be prevented from being correctly extracted in the second directional filtering circuit x2 arranged next to the directional filtering circuit x1.

In the demultiplexing circuit shown in FIG. 11, signals are coupled to the ring-type resonance circuits c1 and c2 and then coupled to the other transmission lines 32 and 33. These signals travel in a direction toward the position where the signal is connected or coupled to the antenna element, not to be transmitted in a direction away from the position in the transmission lines 32 and 33.

In the antenna integrated-type demultiplexer board B shown in FIGS. 8 to 11, the demultiplexing circuit 22 is provided inside the dielectric board 21. However, the demultiplexing circuit 22 can be also formed on a surface, on the opposite side of a surface, where the antenna elements 24 and 25 are formed, of the dielectric board 21, as shown in FIG. 12.

Figure 12:
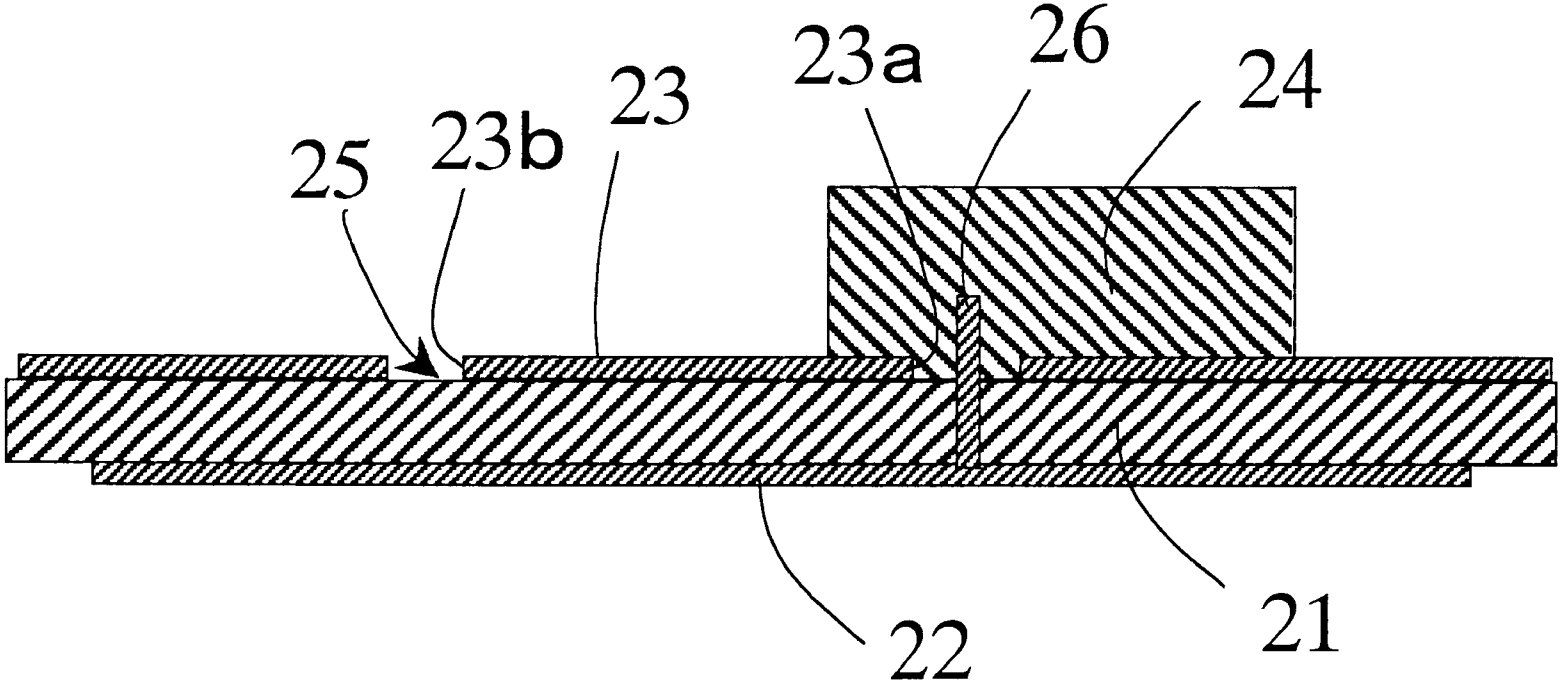
FIG. 12 is a schematic sectional view for explaining a modified example of an antenna integrated-type demultiplexer board.

That is, in the construction shown in FIG. 12, a demultiplexing circuit 22 is applied to the surface, on the opposite side of the surface, where the antenna elements 24 and 24 are formed, of the dielectric board 21. The slot antenna 25 and the demultiplexing circuit 22 are electromagnetically coupled to each other by an arrangement shown in FIG. 10. Further, the dielectric resonator antenna 24 and the demultiplexing circuit 22 are connected to each other such that signal transmission is allowed by a through conductor 26 penetrating through the dielectric board 21.

Even in this construction, a grounding layer 23 is applied to a joint surface of the dielectric board 21 to the antenna element 24. Accordingly, it is possible to prevent the antenna element 24 and the demultiplexing circuit 22 from interfering with each other.

Although in the antenna integrated-type demultiplexer board shown in FIGS. 8 to 12, the slot antenna 25 formed in the grounding layer 23 and the dielectric resonator antenna 24 disposed on the grounding layer 23 are provided on a surface of the dielectric board 21, the present invention is not limited to the same. The antenna element may be composed of only a slot antenna or may be composed of only a dielectric resonator antenna. Further, a slot antenna or a dielectric resonator antenna and another antenna element may be combined with each other and integrated with the dielectric board comprising the demultiplexer.

According to the antenna integrated-type demultiplexer board shown in FIGS. 8 to 12, the dielectric resonator antenna 24 and the dielectric board 21 can be joined to and integrated with each other with adhesives or the like through the grounding layer 23. Where the dielectric board 21 and the dielectric resonator antenna 24 are composed of ceramics, the dielectric resonator antenna 24 and the dielectric board 21 can be integrated with each other by simultaneous sintering.

Where the dielectric board 21 is composed of ceramics, the grounding layers 23 and 27 having the slot antenna 25, the demultiplexing circuit 22, and the through conductor 26 can be formed by sintering simultaneous with the dielectric board 21. That is, metal paste is printed into a pattern and applied to a surface of a dielectric board which has not been sintered yet, to form the grounding layers 23 and 27 having the slot antenna 25 and the demultiplexing circuit 22.

Further, a through hole is formed in the dielectric board which has not been sintered yet and the dielectric resonator antenna 24 which has not been sintered yet, and is filled with conductive paste, to form the through conductor 26. Thereafter, they are simultaneously sintered. The through conductor 26 can be also formed by embedding a metal pin in the dielectric board.

At least one of two or more signals obtained by the branching by the demultiplexing circuit 22 may be connected to an antenna element, and the other signal obtained by the branching can be also connected to a well-known external antenna element such as a wire antenna.

The dielectric board 21 can be formed of a well-known insulating material such as a ceramic material such as alumina, glass ceramics, silicon nitride, or aluminum nitride; an organic insulating material containing organic resin such as epoxy resin; or an organic-ceramic composite material. Particularly, it is desirable that the dielectric board 21 has a dielectric constant of 1 to 200 and has a dielectric loss (at a measured frequency of 3 GHz) of not more than 0.01.

The grounding layers 23 and 27 containing the slot antenna 25, the demultiplexing circuit 22, the through conductor 26, and so forth are formed of a well-known conductive material such as copper, silver, gold, tungsten, or molybdenum.

Although the dielectric resonator antenna 24 is formed of a dielectric material of the same quality as that of the dielectric board 21, it is particularly desirable to use a dielectric material having a low dielectric loss.

The demultiplexing circuit shown in FIG. 11 has a branching characteristic similar to that shown in FIG. 7.

Figure 13:
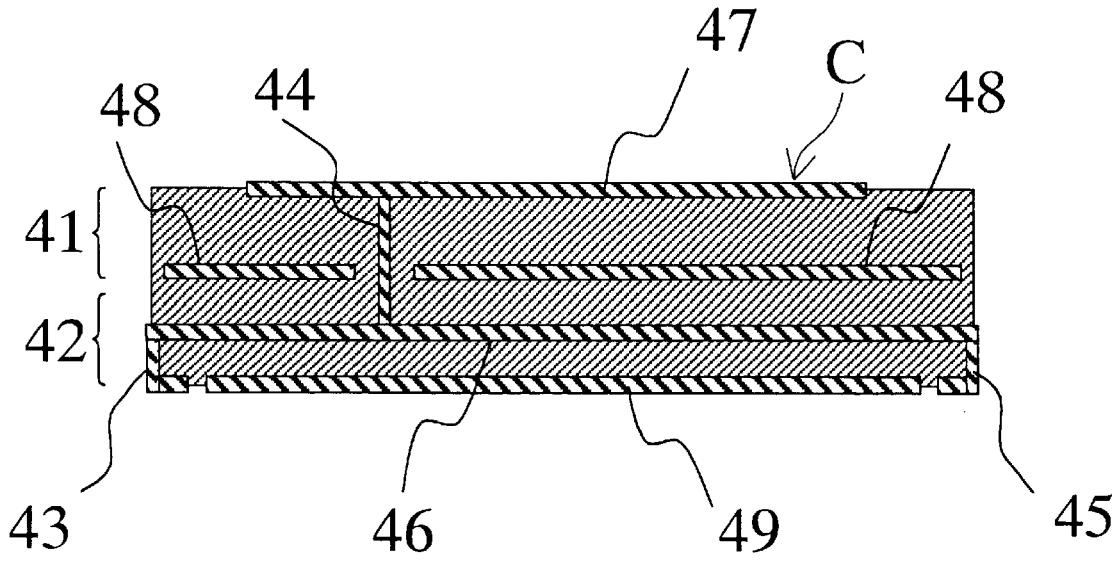
FIG. 13 is a schematic sectional view of a chip antenna component according to a third embodiment of the present invention.
Figure 14A:
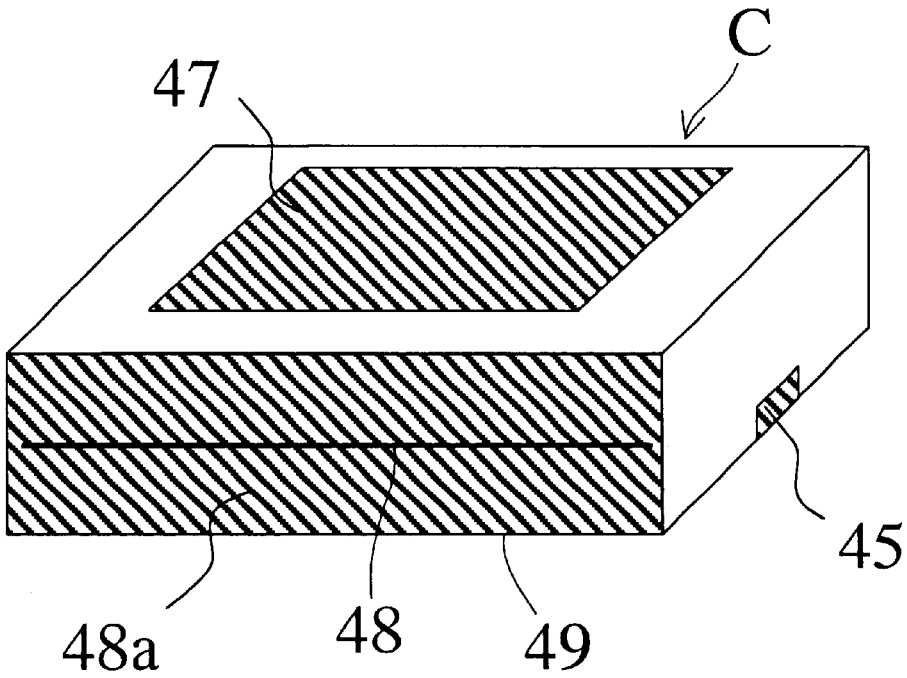
FIG. 14A is a schematic perspective view of the chip antenna component shown in FIG. 13.
Figure 14B:
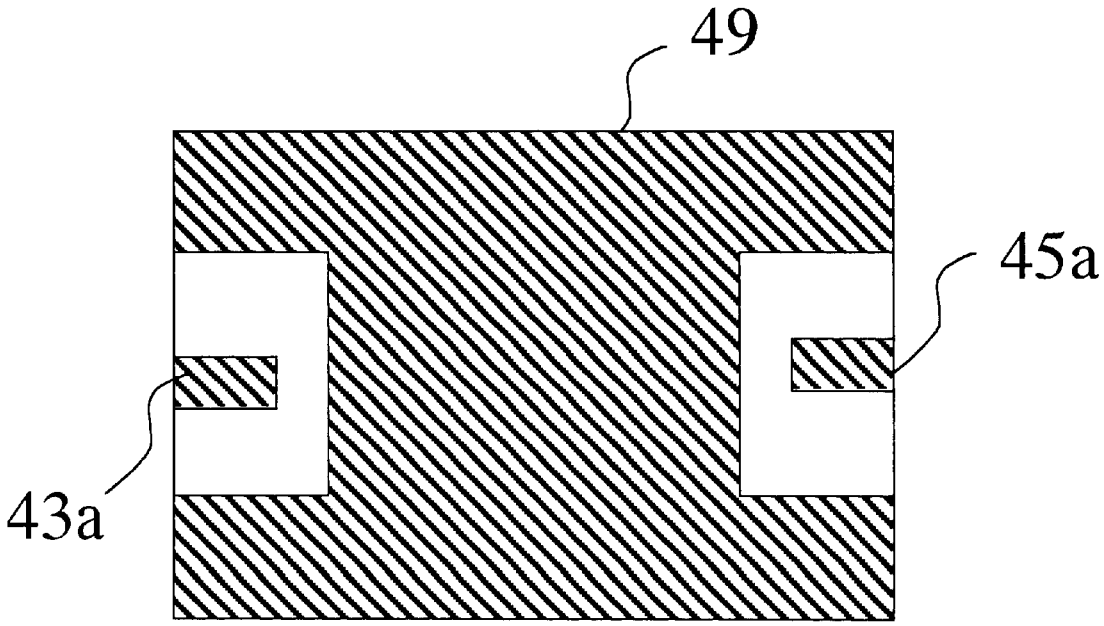
FIG. 14B is a bottom view thereof.

FIG. 13 is a schematic sectional view of a chip antenna component according to a third embodiment of the present invention, FIG. 14A is a schematic perspective view thereof, and FIG. 14B is a bottom view thereof. The chip antenna component C has a structure in which an antenna element 41 and a stacked circuit section 42 are integrated with each other. The stacked circuit section 42 has one signal input terminal 43 and two signal output terminals 44 and 45. The signal output terminal 44 is electrically connected to the antenna element 41.

In the chip antenna component C, the antenna element 41 is composed of a microstrip antenna formed by an antenna radiating conductor 47 and a grounding layer 48. As the stacked circuit section 42, various passive circuits may be formed. In the present embodiment, however, a demultiplexing circuit is formed. A circuit of a strip line is formed by the grounding layer 48 and a grounding layer 49 and a demultiplexing circuit pattern 46 inside the dielectric board of the stacked circuit section 42 in the chip antenna component C.

A grounding layer 48*a* is applied to side surfaces of the antenna element 41 and the stacked circuit section 42. The grounding layer 48 and the grounding layer 49 are electrically connected to each other by the grounding layer 48*a*, and are held at the same potential.

As apparent from FIG. 14B showing a bottom view of the chip component C, the signal input terminal 43 and the one signal output terminal 45 in the stacked circuit section 42 are respectively introduced as connecting pads 43*a* and 45*a* into a bottom surface of the stacked circuit section 42. Electrical connection to another wiring circuit board is achieved through the connecting pads 43*a* and 45*a*. A grounding layer 49 is formed around the connecting pads 43*a* and 45*a*. The grounding layer 49 may be formed inside the stacked circuit section 42.

The pattern of the connecting pads 43*a* and 45*a* is not limited to that shown in FIG. 14B. For example, it may have a coplanar line structure.

The antenna element 41 and the stacked circuit section 42 are integrated with each other by the above-mentioned construction, so that an arrangement of a plurality of antennas is not limited by the structure of a demultiplexer. Consequently, it is possible to provide an antenna component which eliminates the necessity of designing the demultiplexer again even in adding or deleting an antenna and has a high degree of freedom in design. Moreover, the construction is favorable for miniaturization.

Figure 15:
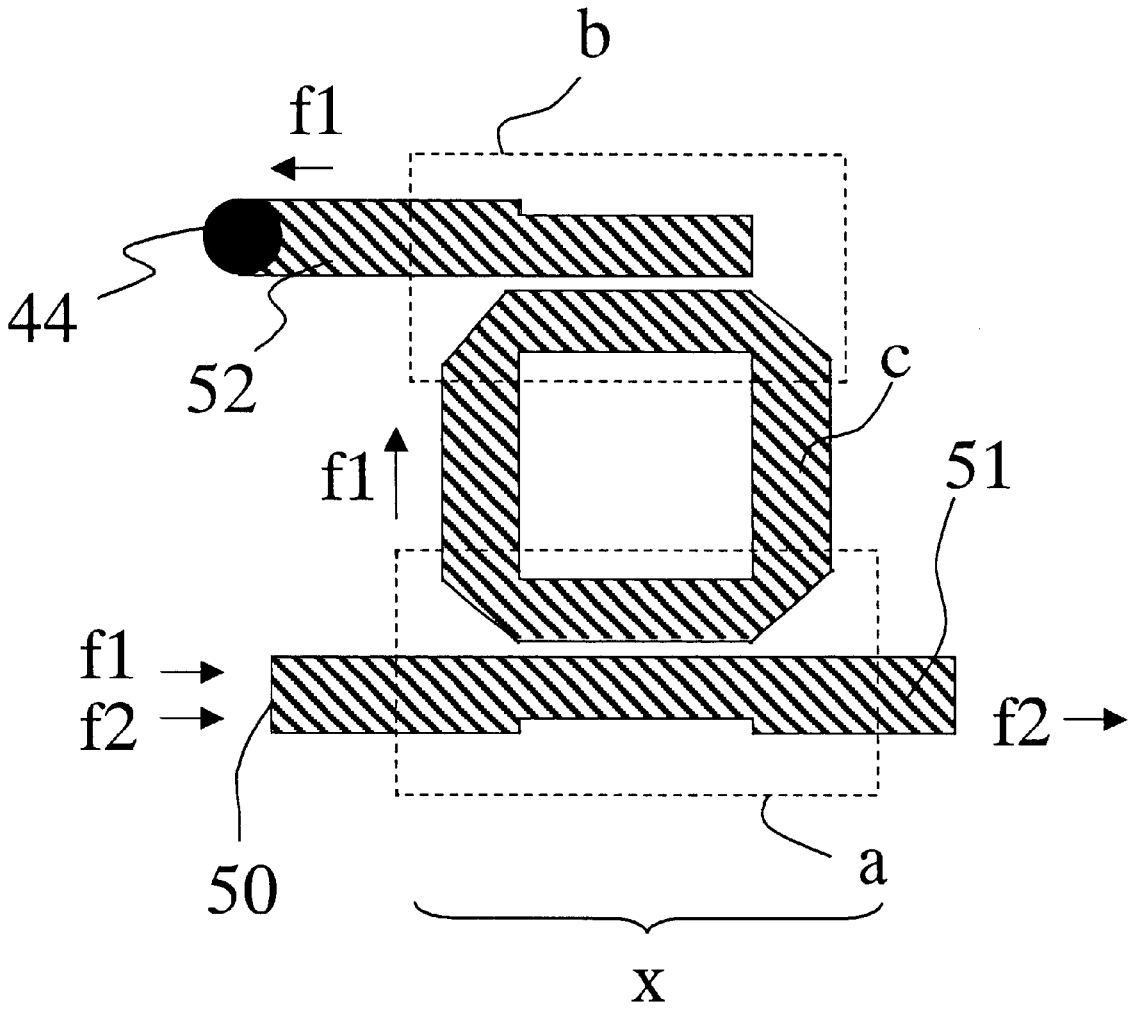
FIG. 15 is a pattern view for explaining a demultiplexing circuit in the chip antenna component shown in FIG. 13.

Although a known circuit can be used as the above-mentioned demultiplexing circuit (a multiplexer) 46, an example of its specific circuit pattern is illustrated in FIG. 15. The demultiplexing circuit 46 comprises a directional filtering circuit x comprising directional coupling circuits a and b and a ring-type resonance circuit c.

In the demultiplexing circuit 26 shown in FIG. 15, two signals f1 and f2 having different frequencies are inputted from a port 50 on the side of a transmitter. One signal f1 is coupled to the ring-type resonance circuit c from a transmission line 51 by the directional coupling circuit a, at a frequency determined by the directional coupling circuit a and the ring-type resonance circuit c in the directional filtering circuit x. The signal f1 is further coupled to another transmission line 52 from the ring-type resonance circuit c by the other directional coupling circuit b formed on the opposite side of the directional coupling circuit a about the ring-type resonance circuit c. The signal f1 is transmitted to the output terminal 44 connected to a power feeding line for feeding power to the antenna element 41. The other signal f2 is transmitted to a second output terminal 45 after traveling through the transmission line 51. The demultiplexing circuit functions as a multiplexer when signal transmission is made in the opposite direction.

Figure 16:
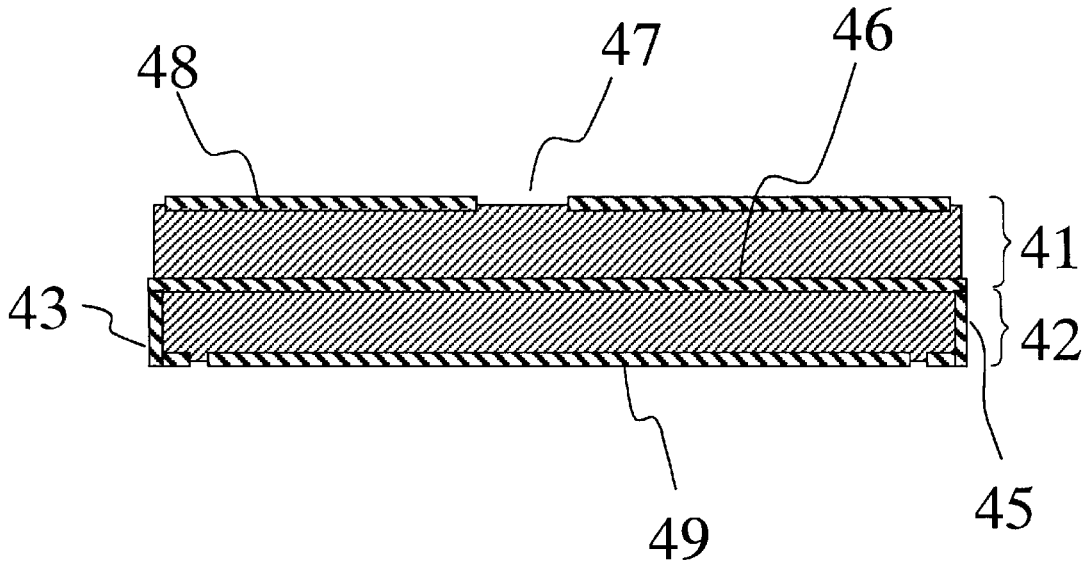
FIG. 16 is a schematic sectional view for explaining a modified example of the chip antenna component shown in FIG. 13.
Figure 17:
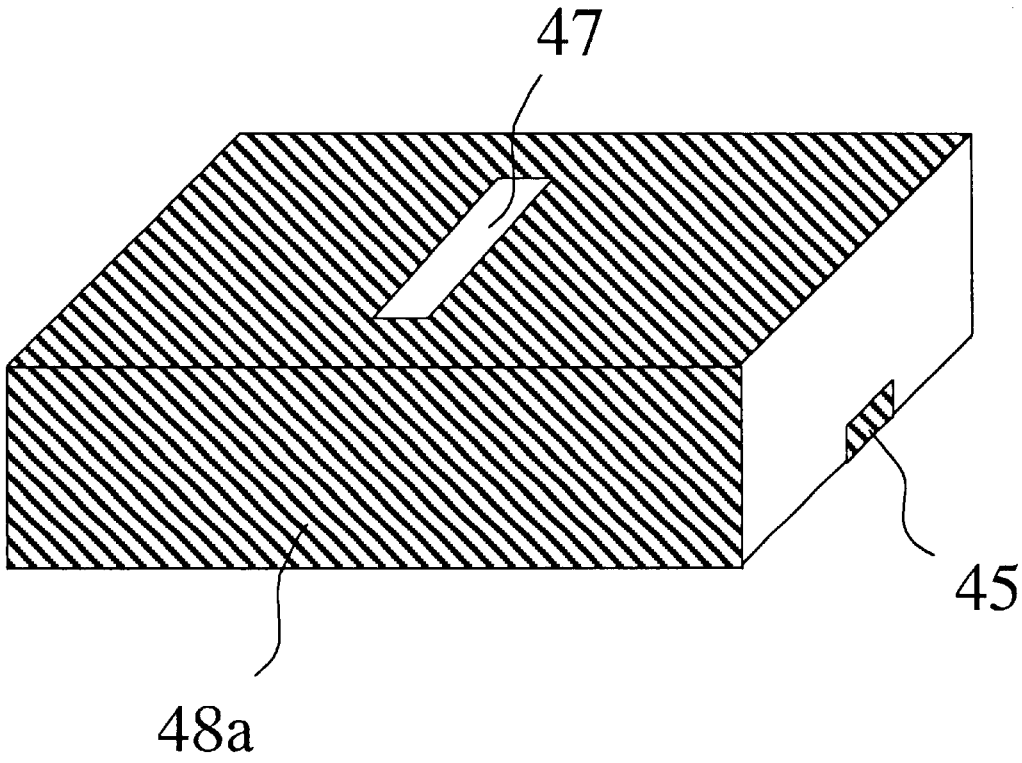
FIG. 17 is a schematic perspective view of the chip antenna component shown in FIG. 16.

FIGS. 16 and 17 illustrate another embodiment. In this construction, an antenna element 41 is a slot antenna constructed by forming a slot 47 in a grounding layer 48. The slot antenna 41 is electromagnetically coupled to a demultiplexing circuit 46 formed inside a stacked circuit section 42. In this case, one of two output terminals does not appear in a physically clear shape but exists as a port at which a signal is electrically extracted from the demultiplexing circuit 46 to the antenna element 41.

Figure 18:
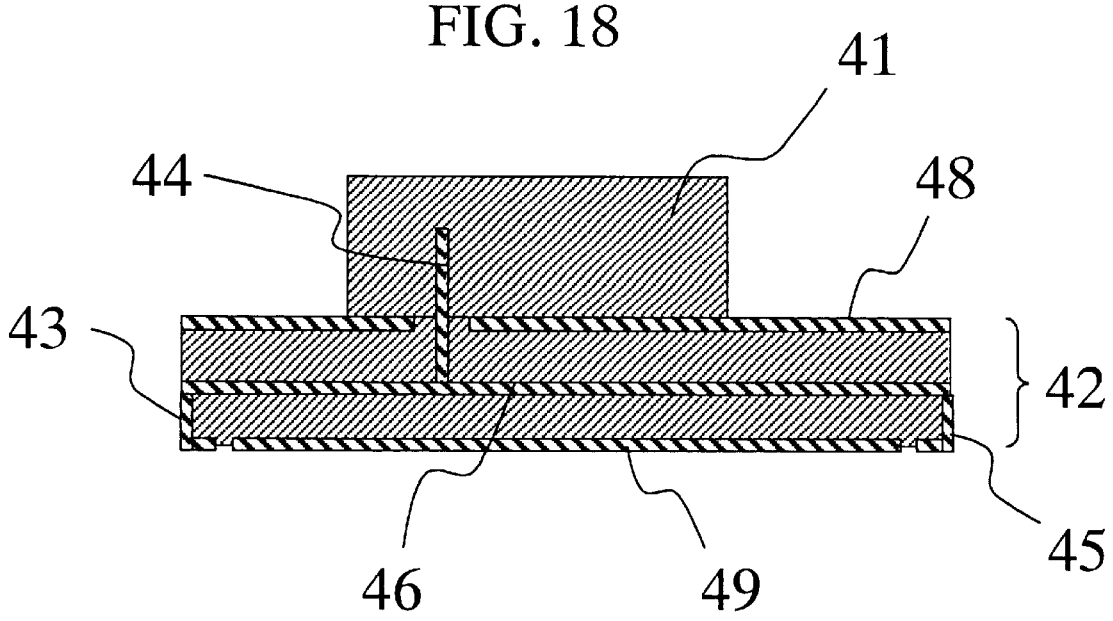
FIG. 18 is a schematic sectional view for explaining another modified example of the chip antenna component.
Figure 19:
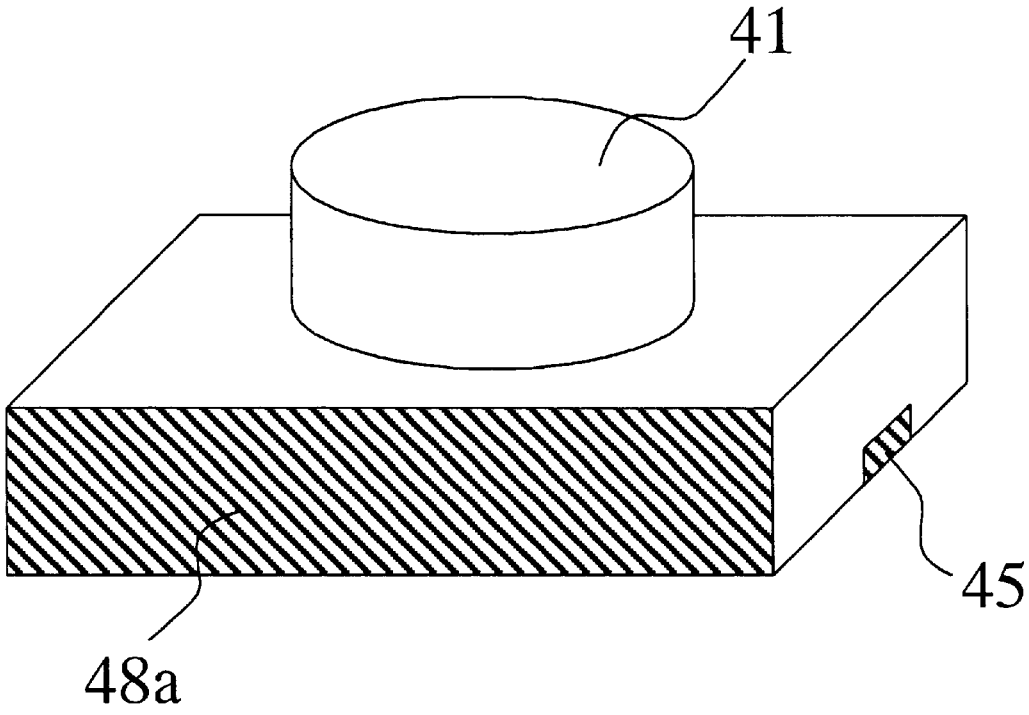
FIG. 19 is a schematic perspective view of the chip antenna component shown in FIG. 18.
Figure 20:
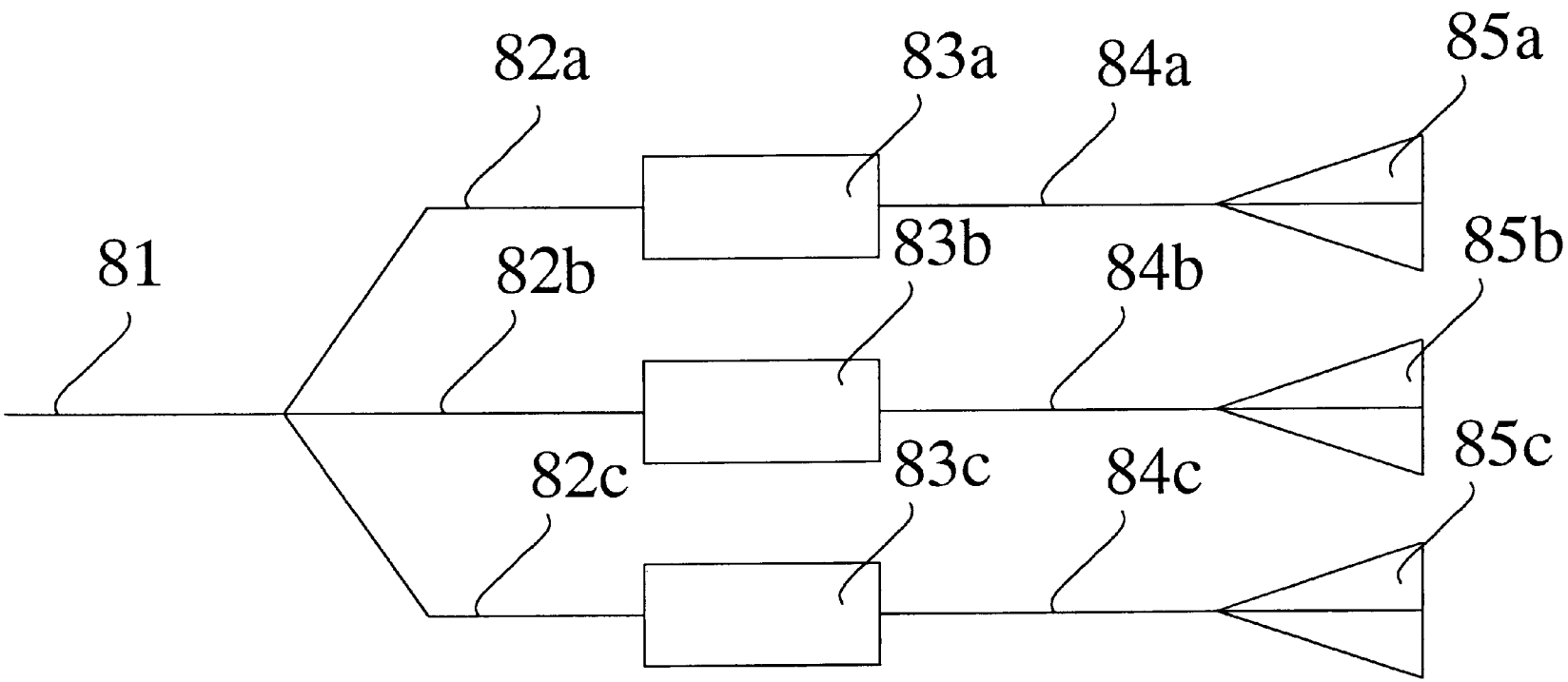
FIG. 20 is a conceptual view of a circuit comprising an antenna and a demultiplexing circuit.

FIGS. 18 and 19 illustrate still another embodiment. In this construction, a dielectric resonator antenna 41 is joined to and integrated with a surface of a stacked circuit section 42 containing a demultiplexing circuit 46.

Even in either of the shapes shown in FIGS. 13 to 19, the antenna element 41 and the stacked circuit section 42 can be joined to and integrated with each other with adhesives or the like. When the antenna element 41 and the stacked circuit section 42 are composed of ceramics, the antenna element 41 and the stacked circuit section 42 can be also integrated with each other by sintering.

A through conductor 44 serving as an output terminal for connecting the circuit such as the demultiplexing circuit 46 contained in the stacked circuit section 42 and the antenna element 41 to each other may be formed by filling a hole provided in a dielectric composing the antenna element 41 and the stacked circuit section 42 with a conductor or embedding a metal pin into the hole. When the dielectric is ceramics, the grounding layers 48 and 49 and the demultiplexing circuit 46 can be formed on the antenna element 41 by simultaneous sintering after applying metal paste and filling the through hole with the metal paste.

A circuit such as a power distributing circuit or a phase shifting circuit can be also used as a circuit formed inside the stacked circuit section 42. Consequently, it is possible to provide a small-sized chip antenna component which is easy to handle for the purpose of forming an array antenna operating at a single frequency, for example.

The antenna element 41 and the stacked circuit section 42 can be formed of a known insulating material, for example, a ceramic material such as alumina, glass, glass ceramics, or aluminum nitride; an organic insulating material containing organic resin such as epoxy resin; or an organic-ceramic composite material. The antenna element 41, the grounding layers 48 and 49, the input terminal 43, the output terminals 44 and 45, the demultiplexing circuit 46, and so forth can be formed of a well-known conductive material such as copper, silver, gold, tungsten, or molybdenum.

Although the antenna element 41 and the stacked circuit section 42 may be formed of the same dielectric material, a dielectric material having a suitable dielectric constant may be suitably selected in consideration of a frequency to be used, a request for miniaturization, processing precision, radiation efficiency, and so forth.

The stacked circuit section 42 inherently has a passive circuit. Examples of such a passive circuit include a power distributing circuit and a phase shifting circuit in addition to the above-mentioned demultiplexing circuit and/or multiplexer. The passive circuit may be formed of a combination of one or two or more of such circuits.

The chip antenna component according to the present embodiment has an input terminal and an output terminal. Accordingly, such a component can be mounted by solder or the like on a surface of a predetermined wiring board. Consequently, an antenna component having a demultiplexing circuit can be mounted on predetermined positions of any wiring boards, for example, thereby making it possible to further increase the degree of freedom in circuit design.

Although the present invention has been described and illustrated in detail, it is clearly understood that the same is by way of illustration and example only and is not to be taken by way of limitation, the spirit and scope of the present invention being limited only by the terms of the appended claims.

This application is based on Japanese Patent Application Serial No. 11-301708 filed with the Japanese Patent Office on Oct. 22, 1999, No. 2000-072747 filed with the Japanese Patent Office on Mar. 15, 2000, and No. 2000-130988 filed with the Japanese Patent Office on Apr. 28, 2000, the disclosures of which are incorporated herein by reference.

What is claimed is:

1. A high frequency circuit integrated-type antenna component, comprising:

a dielectric board having two opposed surfaces and an inner part defining the portion of the board between the two opposed surfaces and having a high frequency circuit formed on one of the surfaces or in the inner part;

a grounding layer formed on a portion of one surface of the dielectric board where the high frequency circuit is not formed;

an antenna element provided in or on the grounding layer; and coupling means for coupling the antenna element with the high frequency circuit for signal transmission therebetween, wherein the high frequency circuit includes one or more circuits selected from the group consisting of a demultiplexer and a multiplexer.

2. The antenna component according to claim 1, wherein the demultiplexing circuit and/or the multiplexer includes a directional coupling circuit and a ring resonance circuit.

3. The antenna component according to claim 1, wherein the antenna element provided on the grounding layer includes a planar antenna element.

4. The antenna component according to claim 3, wherein the planar antenna element includes a microstrip antenna.

5. The antenna component according to claim 1, wherein the high frequency circuit includes a demultiplexing circuit, the demultiplexing circuit including a directional filtering circuit having a directional coupling circuit and a ring resonance circuit.

6. The antenna component according to claim 1, wherein an antenna board having the antenna element provided on one surface of a dielectric board is integrally fixed to the grounding layer.

7. The antenna component according to claim 6, wherein the grounding layer is formed on one of surfaces, a surface of the antenna board, or an antenna mounting surface of the dielectric board provided with the high frequency circuit.

8. The antenna component according to claim 6, wherein the antenna board and the dielectric board provided with the high frequency circuit respectively have grounding layers, and the grounding layers are electrically connected to each other.

9. The antenna component according to claim 6, wherein the dielectric board in the antenna board and the dielectric board provided with the high frequency circuit are integrated with each other, and an antenna element is formed on a surface of the integrated dielectric boards.

10. The antenna component according to claim 9, wherein a plurality of antenna elements which differ in frequencies to be used are formed on the surface of the integrated dielectric boards.

11. The antenna component according to claim 10, wherein the plurality of antenna elements which differ in frequencies to be used are provided on the grounding layer.

12. The antenna component according to claim 10, wherein the plurality of antenna element boards respectively provided with the antenna elements which differ in frequencies to be used are integrally fixed to the grounding layer.

13. The antenna component according to claim 1, wherein the antenna element provided on the grounding layer includes a dielectric resonator antenna disposed on the grounding layer.

14. The antenna component according to claim 13, wherein the coupling means includes a through conductor penetrating through the dielectric board from the high frequency circuit and extending into the dielectric resonator antenna.

15. The antenna component according to claim 1, wherein the antenna element includes an antenna element formed in the grounding layer.

16. The antenna component according to claim 1, wherein the antenna element provided in the grounding ayer includes a slot antenna.

17. The antenna component according to claim 16, wherein the coupling means includes means for electromagnetically coupling the slot antenna and the high frequency circuit.

18. A high frequency circuit integrated-type antenna component, comprising:

a dielectric board having two opposed surfaces and an inner part defining the portion of the board between the two opposed surfaces and having a high frequency circuit formed on one of the surfaces or in the inner part;

a grounding layer formed on a portion of one surface of the dielectric board where the high frequency circuit is not formed;

an antenna element provided in or on the grounding layer; and coupling means for coupling the antenna element with the high frequency circuit for signal transmission therebetween wherein the high frequency circuit includes a demultiplexing circuit, the demultiplexing circuit including a plurality of directional filtering circuits which differ in operation frequencies.

19. The antenna component according to claim 18, wherein the plurality of directional filtering circuits are arranged in descending order of their operation frequencies from a side of power feeding.

20. A chip antenna component comprising:

at least one antenna element; and a stacked circuit section integrated with the antenna element and including at least one signal input terminal and two or more signal output terminals, at least one of the signal output terminals being connected to the antenna element, wherein a demultiplexing circuit and/or a multiplexer is formed on the stacked circuit section, and wherein at least one signal input terminal and at least one the signal output terminals are each introduced into a bottom surface of the stacked circuit section for electrically connecting the signal input terminal and the at least one of the signal output terminals to another wiring circuit board.

21. The chip antenna component according to claim 20, wherein the demultiplexing circuit and/or the multiplexer includes a directional coupling circuit and a ring resonance circuit.

22. The chip antenna component according to claim 20, wherein the antenna element is a planar antenna.

23. The chip antenna component according to claim 22, wherein the planar antenna includes a microstrip antenna.

* * * * *